US005531527A

United States Patent [19]

Maekawa et al.

[11] Patent Number: 5,531,527

[45] Date of Patent: Jul. 2, 1996

[54] APPARATUS AND METHOD FOR VIDEO PRINTING

[75] Inventors: Tomohiro Maekawa; Hitoshi Kamoda; Yasuji Yui, all of Kanagawa; Shin Iima, Tokyo; Takashi Bunya, Kanagawa, all of Japan

[73] Assignee: Sony Corporation, Tokyo, Japan

[21] Appl. No.: 234,980

[22] Filed: Apr. 28, 1994

[30] Foreign Application Priority Data

May 14, 1993 [JP] Japan ..... 5-113060

[51] Int. Cl.[6] ..... B41J 23/00; B41J 33/14

[52] U.S. Cl. ..... 400/185; 400/120.02; 400/187; 400/234; 400/231

[58] Field of Search ..... 400/120.01, 120.02, 400/120.16, 185, 187, 223, 224.2, 234, 236, 636, 120.17, 207, 208, 231, 236.2

[56] References Cited

U.S. PATENT DOCUMENTS

| | | | |
|---|---|---|---|
| 3,384,216 | 5/1968 | Thayer . | |
| 4,218,151 | 8/1980 | Kondur, Jr. . | |
| 4,285,507 | 8/1981 | Marinoff . | |
| 4,496,955 | 1/1985 | Maeyama et al. . | |
| 4,564,187 | 1/1986 | Costa et al. . | |
| 4,625,218 | 11/1986 | Watanabe | 346/76 |
| 4,901,090 | 2/1990 | Ozawa et al. | 400/207 |
| 4,910,533 | 3/1990 | Sasaki et al. . | |
| 4,970,531 | 11/1990 | Shimizu et al. . | |
| 5,005,998 | 4/1991 | Takanashi et al. . | |
| 5,037,218 | 8/1991 | Shimizu et al. . | |
| 5,061,099 | 10/1991 | Iwatani et al. . | |
| 5,079,565 | 1/1992 | Shimizu et al. . | |
| 5,087,137 | 2/1992 | Burnard et al. . | |
| 5,290,114 | 3/1994 | Asami et al. . | |
| 5,352,048 | 10/1994 | Mizoguchi et al. . | |
| 5,385,416 | 1/1995 | Maekawa et al. | 400/208 |

FOREIGN PATENT DOCUMENTS

| | | |
|---|---|---|
| 0413358 | 2/1991 | European Pat. Off. . |
| 0472471 | 2/1992 | European Pat. Off. . |
| 0515224 | 11/1992 | European Pat. Off. . |
| 0521521 | 1/1993 | European Pat. Off. . |
| 3932999 | 4/1990 | Germany . |
| 61-51380 | 3/1986 | Japan . |
| 61-184248 | 8/1986 | Japan . |
| 63-254085 | 10/1988 | Japan . |
| 1210365 | 8/1989 | Japan . |
| 2-20368 | 1/1990 | Japan . |
| 2-95875 | 4/1990 | Japan . |
| 2169283 | 6/1990 | Japan . |
| 2169284 | 6/1990 | Japan . |
| 3-292177 | 12/1991 | Japan . |
| 2195956 | 4/1988 | United Kingdom . |

OTHER PUBLICATIONS

Partial EPO Search Report.

Patent Abstract of Japan, vol. 14, No. 157, Mar. 27, 1990.

*Primary Examiner*—John S. Hilten

*Attorney, Agent, or Firm*—Ronald P. Kananen

[57] ABSTRACT

A video printing apparatus and method in which, without interlocking the movement of the printing head with the capstan for carrying the printing paper and the paper feeding mechanism by a cam and linkage mechanism, they are respectively operated by three independent motors. The printer includes a first normally and reversely rotatable DC motor for searching the head of the ink ribbon of the ribbon cassette housed in the printer and for taking up the ink ribbon by the take-up reel base during the printing operation. A second normally and reversely rotatable stepping motor is provided for carrying the printing paper housed in the tray by the capstan and the pinch roller to the printing position and the paper delivering position. A third normally and reversely rotatable DC motor is provided for moving the printing head which subjects the printing paper to the printing processing by pressing the ink ribbon of the ribbon cassette thereon in cooperation with the platen. A control mechanism for locking the tray in position, pressing the printing paper in the tray into engagement with a first feeding roller and moving the pinch roller into engagement with the capstan includes a plurality of cams disposed on a common axis which are driven by the first motor.

31 Claims, 28 Drawing Sheets

H0

H1, H2, H3, H3', H4

HO, PO

H2, P1

H3, P2

H4, P2

APPARATUS AND METHOD FOR VIDEO PRINTING

BACKGROUND OF THE INVENTION

1. Field of the Invention

The present invention relates generally to a printer for saving a recording picture, such as a video picture or the like, as a hard copy, and particularly to a sublimation type thermal transfer system video printer for producing a hard copy of a video picture.

2. Description of the Related Art

Conventional video printers include a gear mechanism for searching a head of an ink ribbon of a ribbon cassette housed in the printer and taking up the ink ribbon by a take-up reel during a printing operation using a DC motor as a drive source. These printers typically include a gear mechanism for feeding a printing paper housed in a tray, and a cam mechanism for pressing the ink ribbon on the printing paper and moving a printing head, which subjects the printing paper to a printing processing. A DC motor is provided for moving the printing head and for use as a drive source to rotate a capstan for carrying the printing paper to a printing position and a paper delivering position successively. A complex cam mechanism and a link mechanism are required to drive the paper feeding mechanism, the cam mechanism and the printing head with a single drive motor. Other printer devices include a stepping motor as a second drive source for driving one or more of the printer mechanisms.

These conventional printers suffer from a linkage and drive mechanism which is complex and space consuming and fails to provide effective operation in the event of paper jams or other interruptions during normal printing operations. Thus, one object of the present invention is to provide a printer construction whereby miniaturization of the printer can be realized and printer operations can be enhanced under adverse conditions.

Another problem with conventional video printers is that they waste printer ribbon between successive printing operations. Conventional printers typically include a mechanism for holding a printing paper and an ink ribbon between a printing head and a platen and use a stepping motor as a drive source and a cam mechanism for pressing and heating the ink ribbon on the printing paper for printing processing. When the ink ribbon is released from the printing paper, it has a slack between the supply reel and the take-up reel of the ribbon cassette. This slack is typically removed by winding the ribbon in the direction of winding during the printing operation, thereby increasing the amount of ribbon required for printing. In addition, identification systems on-ribbon cassettes often require rotation of the take-up and/or supply reels resulting in further waste of the ink ribbon. Accordingly, it is a further object of the present invention to eliminate wasteful usage of ink ribbon in printer devices.

Yet another problem with conventional video printers is that the printer head moving mechanism is typically interconnected with the paper moving mechanism or the ribbon identification mechanism such that the printing head cannot be moved independent of those mechanisms. This results in unnecessary movement of the printing head during paper feeding and ribbon identification, and restricts the use of the printing head for guiding the printing paper into a printing position. Thus, a further object of the present invention is to provide a driving mechanism for a printer which allows the printing head to be freely moved while maintaining a compact printer arrangement.

SUMMARY OF THE INVENTION

In order to achieve the above-mentioned objects, in a printer for producing a hard copy of a recording picture, the printer according to the present invention comprises a normally and reversely rotatable first drive motor for searching a head of an ink ribbon of a ribbon cassette housed in the printer and for taking up the ink ribbon by a take-up reel during a printing operation, a normally and reversely rotatable second drive motor for feeding a printing paper housed in a tray through a carrying roller by a capstan and a pinch roller to a printing position and a paper delivering position, and a normally and reversely rotatable third drive motor for identifying the ink ribbon by a ribbon code ring and for moving a printing head, which subjects the printing paper to a printing processing, by pressing the ink ribbon thereon with a platen.

According to the printer of the present invention constructed as described above, first, in order to detect a header mark of the ink ribbon in the ribbon cassette, the take-up reel is rotated by the first drive motor to take up the ink ribbon by a predetermined amount, and then the head of the ink ribbon is searched.

Next, the printing paper housed in the tray is carried by the capstan through drive of the second drive motor and carried to the printing position with a length of the printing paper discriminated.

Then, when it is determined that the printing paper has a length of a regular paper, under such a state that the printing head moved through a cam mechanism rotated by drive of the third drive motor is pressed on the printing paper through the ink ribbon, the printing paper and the ink ribbon are carried and subjected to the printing processing.

As explained above, in the printer for producing the hard copy of the recording picture, the printer according to the present invention is formed of the normally and reversely rotatable first drive motor for taking up the ink ribbon of the ribbon cassette housed in the printer by the take-up reel, the normally and reversely rotatable second drive motor for feeding the printing paper housed in the tray through the carrying roller by the capstan roller and the pinch roller to the printing position and the paper delivering position, and the normally and reversely rotatable third drive motor for moving the printing head which subjects the printing paper to the printing processing by pressing the ink ribbon thereon with the platen roller. Therefore, even in case of the jam of the printing paper, interruption during the printing operation or the like, the printing paper can be carried and the ink ribbon can be taken up while the head is being moved at the most proper timing, so that when the power source is supplied again, operation can be automatically restored.

Also, the miniaturization of the printer can be realized. The head can also be freely moved, whereby the printing paper can be pushed down and the passage of the paper can also be provided at the printing unit. Therefore, the printer can be further miniaturized.

Also, when the printing paper and the ink ribbon are not matched with each other, the printing paper is automatically delivered and the ink ribbon is rewound, whereby the wasteful use of the ink ribbon can be prevented.

BRIEF DISCLOSURE OF THE DRAWINGS

FIG. 17A to 17D are diagrams of respective relations of respective stop positions H0 to H4 of the gear 305 and rotation positions of a cam groove 308*a*, a cam groove 308*b* and a cam groove 309*a*.

FIG. 18A to 18D are diagrams of respective relations of stop positions H2a and H2b of the gear 305 and the rotation positions of the cam groove 308*a*, the cam groove 308*b* and the cam groove 309*a*.

Figure 19:
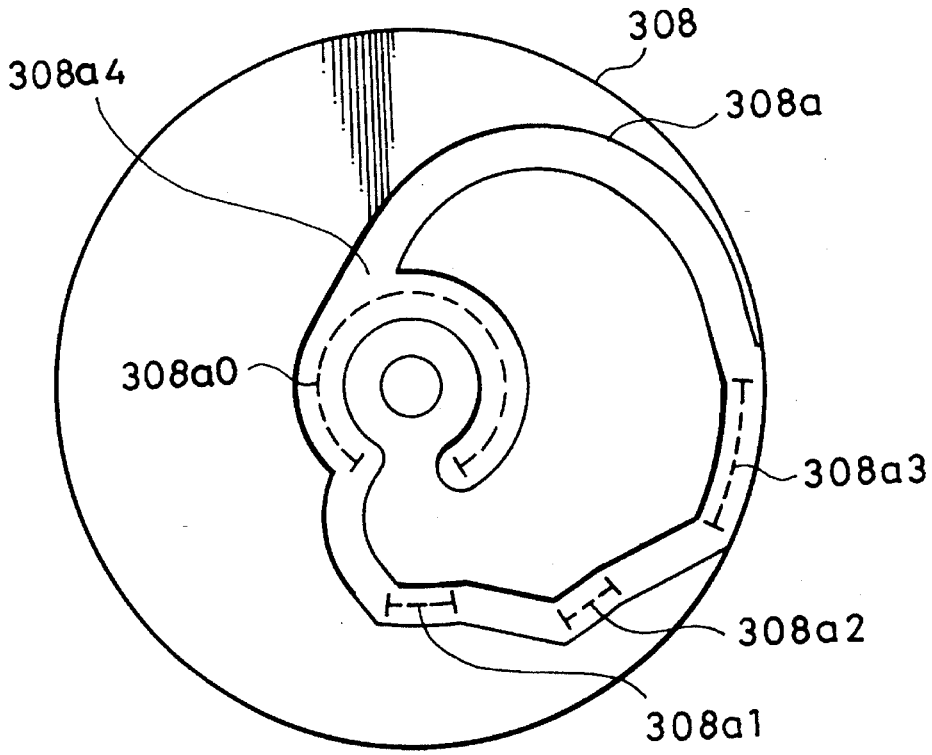

FIG. 19 is a detailed diagram of the cam groove 308*a*.

Figure 20:
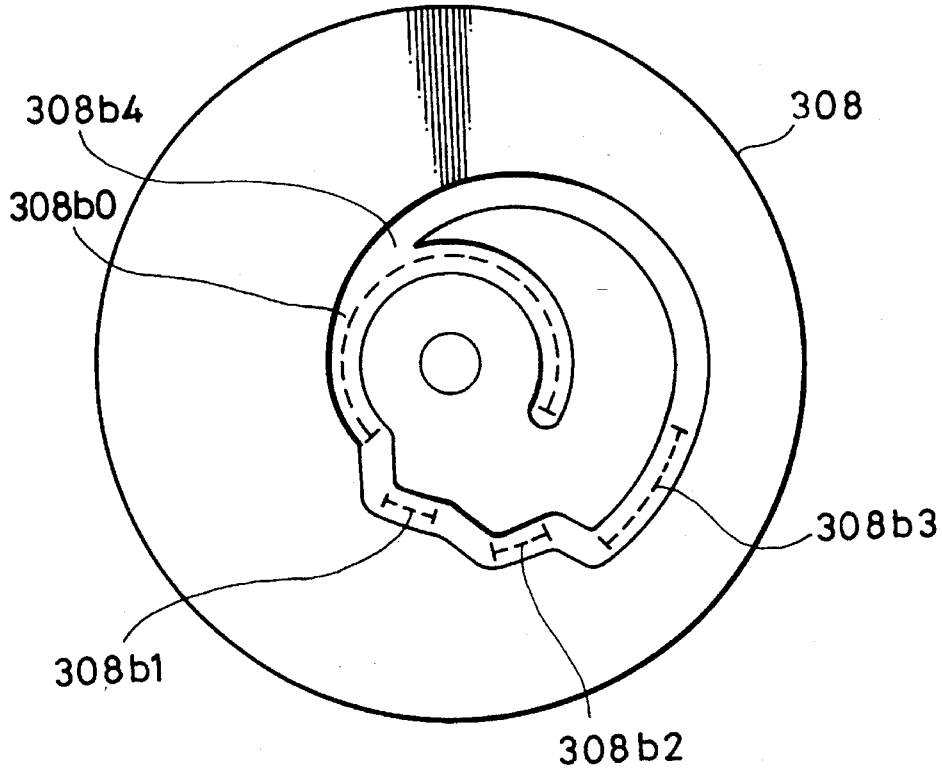

FIG. 20 is a detailed diagram of the cam groove 308*b*.

Figure 21:
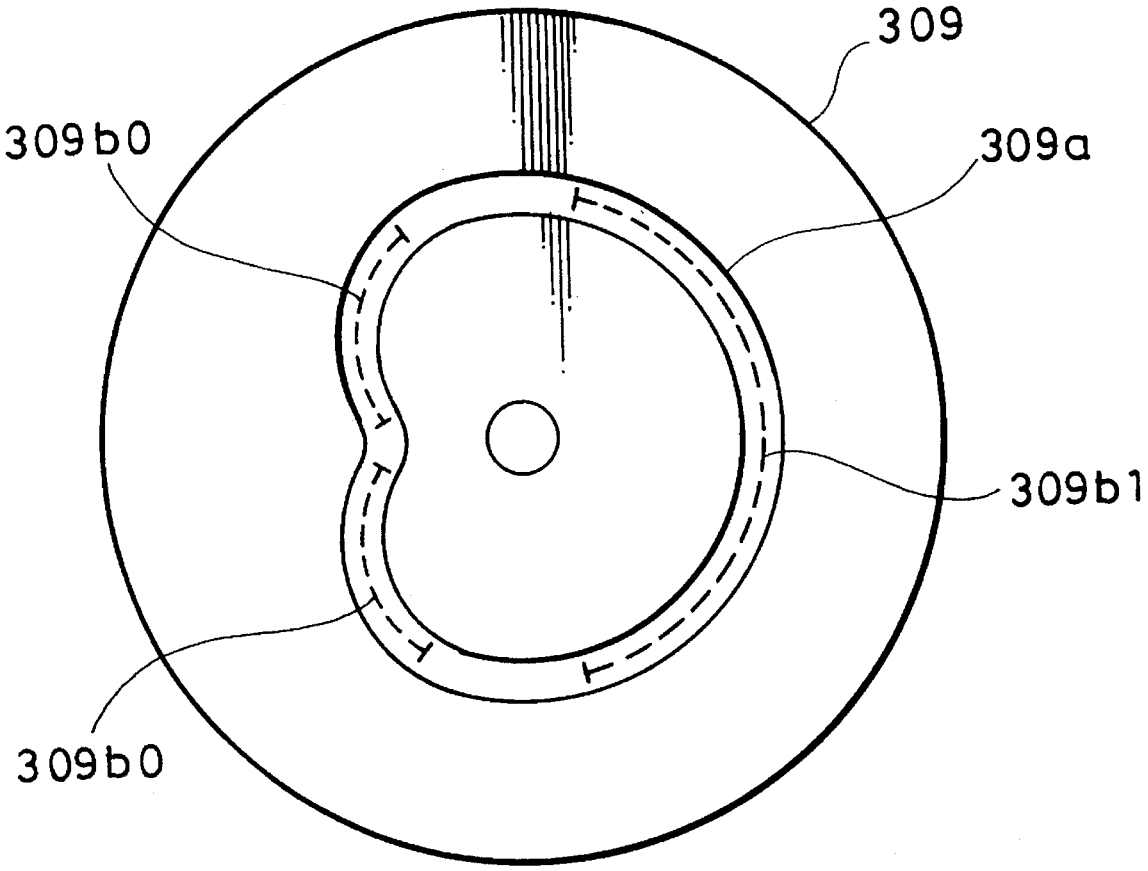

FIG. 21 is a detailed diagram of the cam groove 309*a*.

Figure 22:
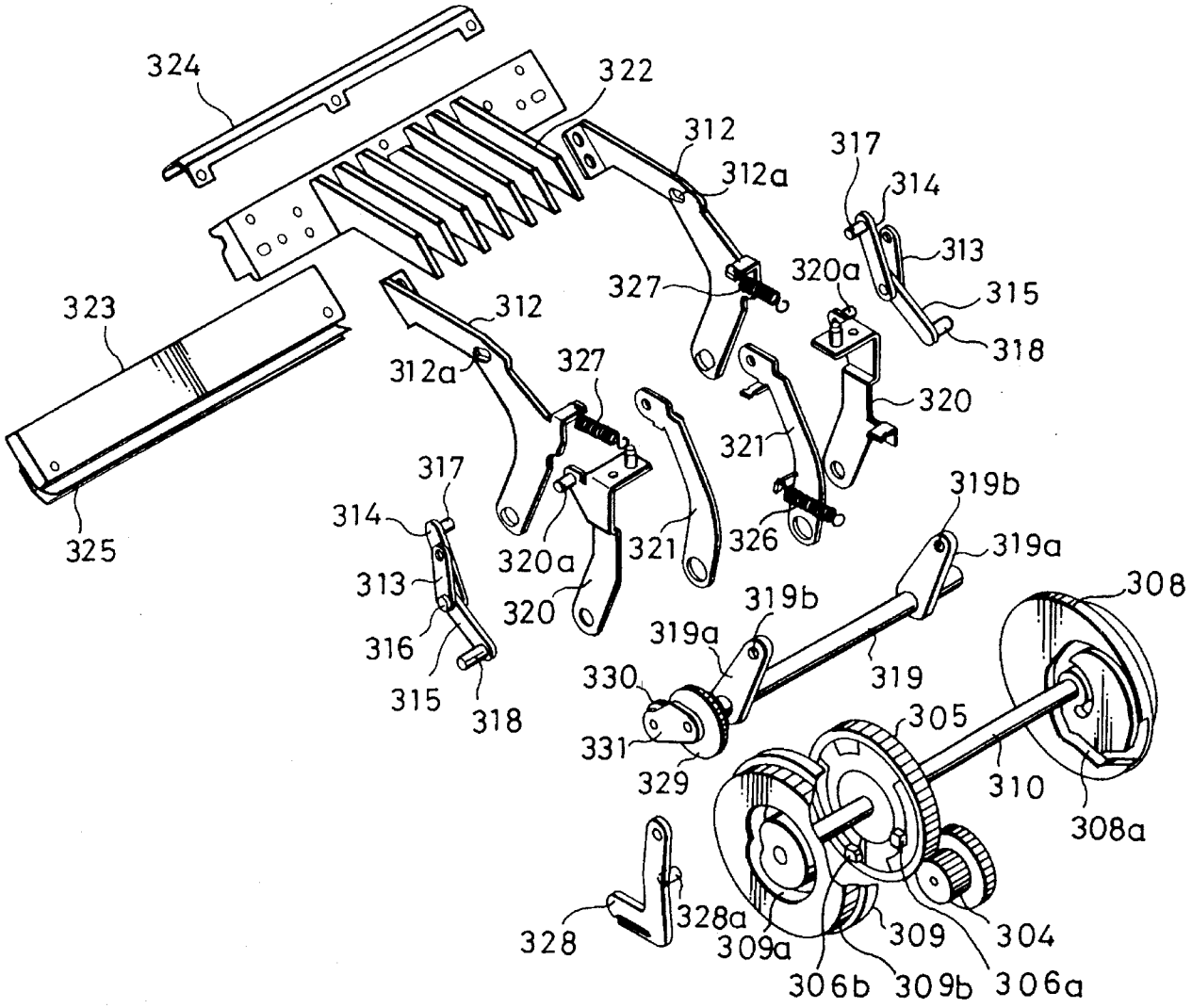

FIG. 22 is an exploded perspective view of a mechanism unit of a head arm portion.

FIG. 23A to 23D are diagrams of positional relation of the cam groove 308*a* and a head 323 upon respective operations.

FIG. 24A to 24D are diagrams of respective operations of the change arm.

Figure 25A:
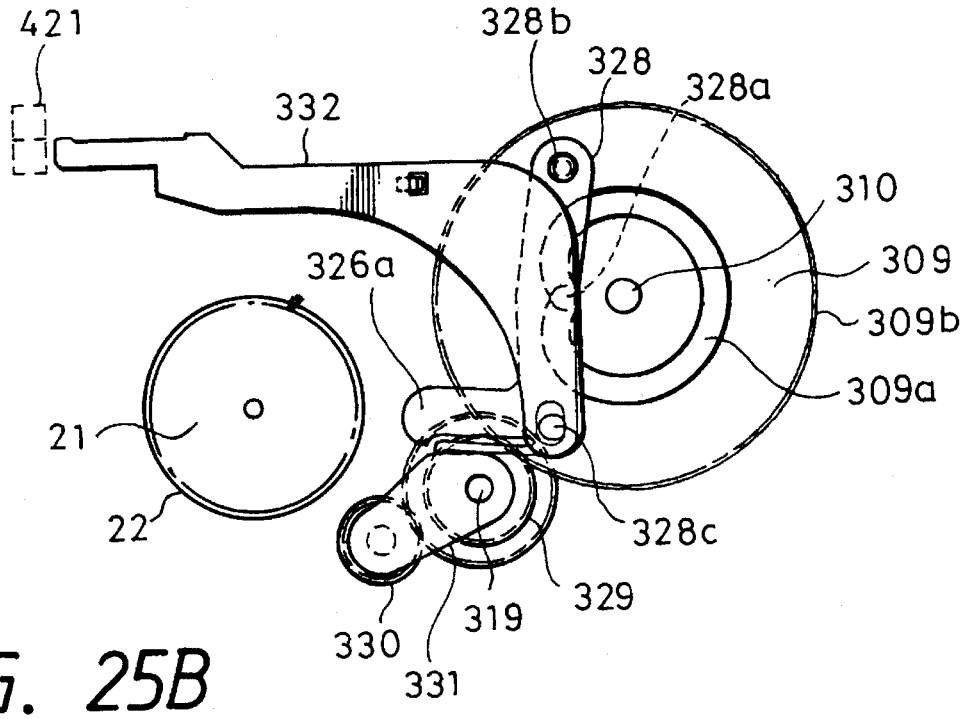
Figure 25B:
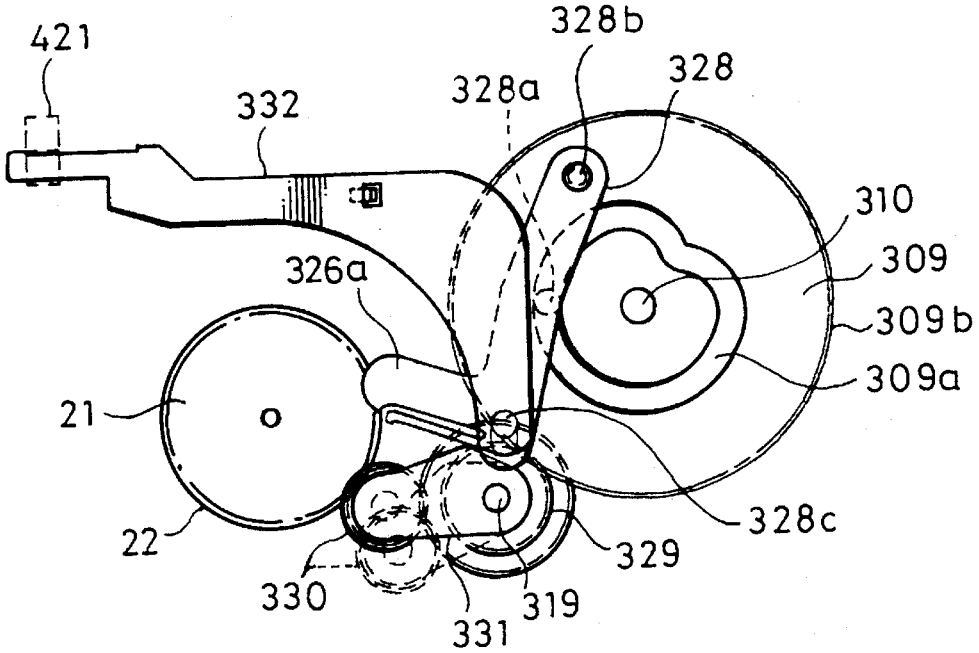

FIG. 25A and 25B are diagrams of relation of operation of the cam groove 309*a* and a pendulum gear 330 and a locking lever 332.

Figure 26:
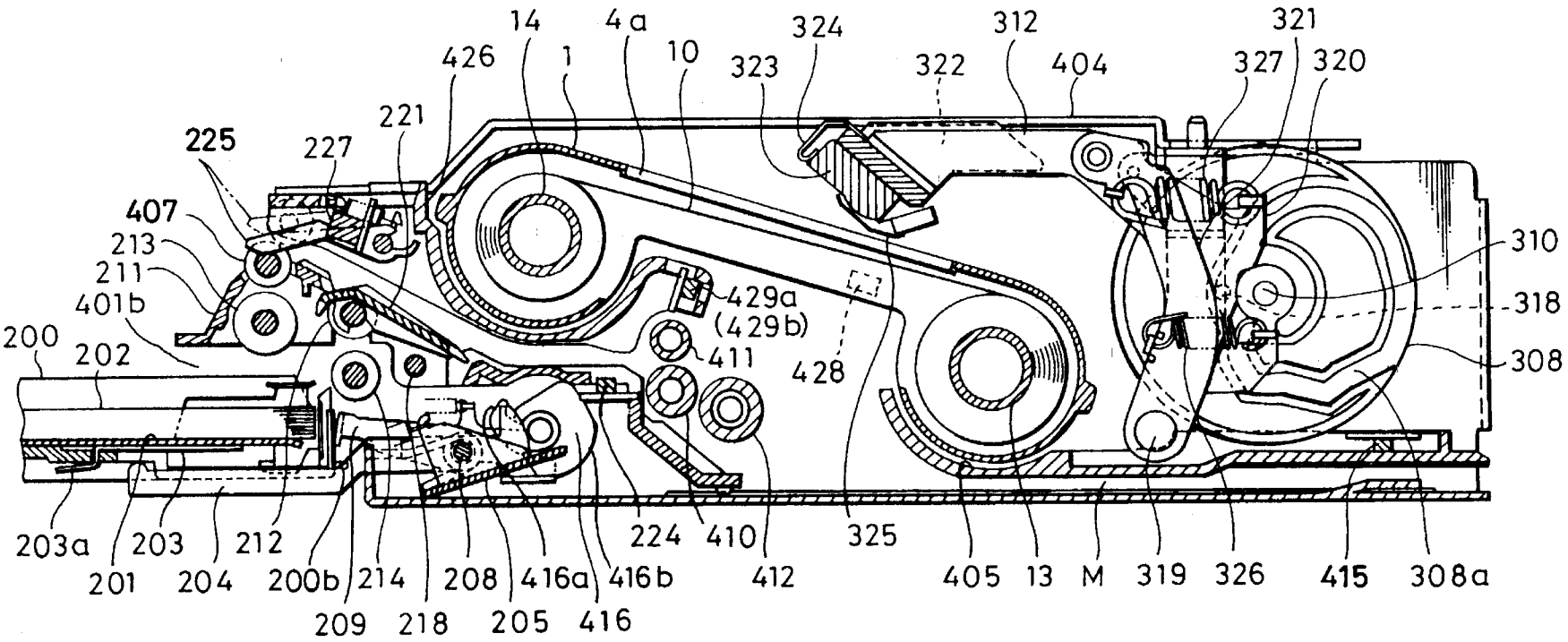

FIG. 26 is a diagram of operation of a head position H0 and a paper position P0 of the printer.

Figure 27:
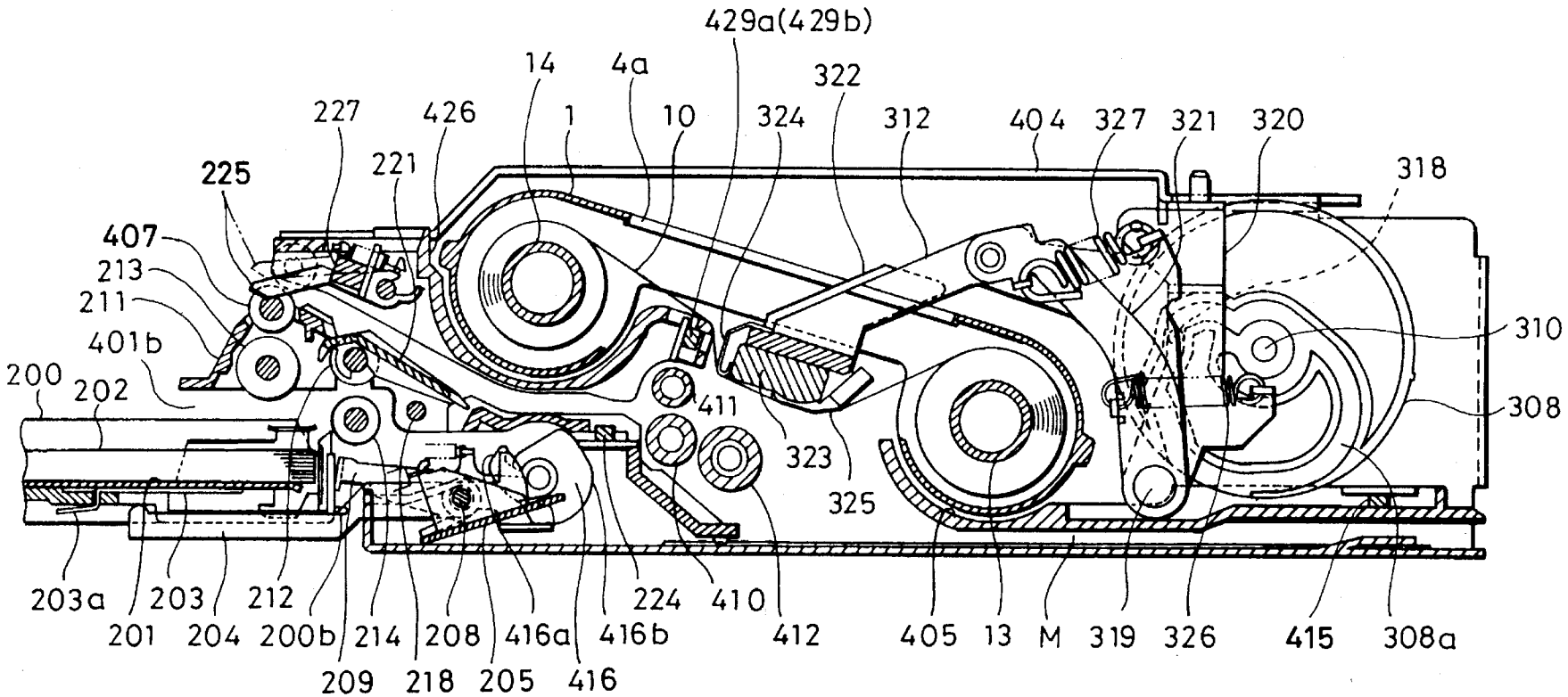

FIG. 27 is a diagram of operation of a head position H2 and a paper position P0 of the printer.

Figure 28:
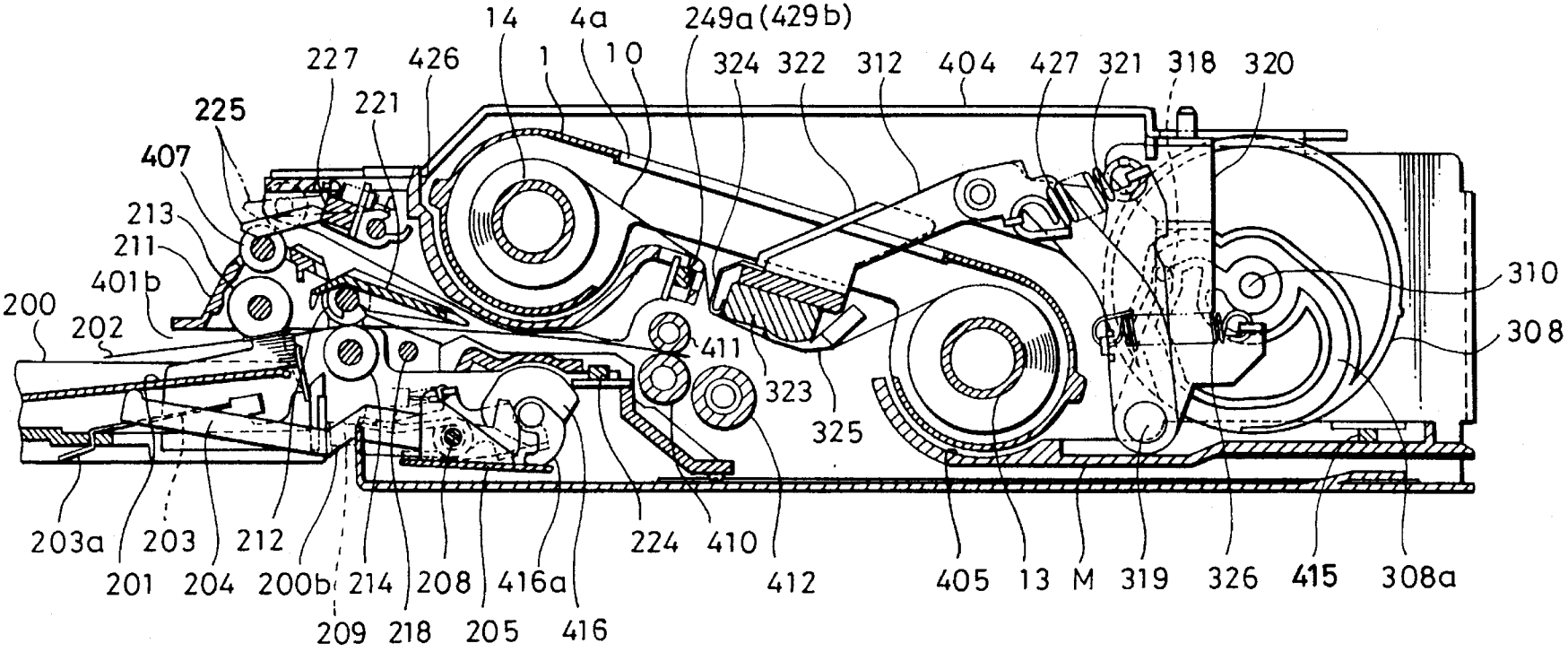

FIG. 28 is a diagram of operation of the head position H2 and a paper position P1 of the printer.

Figure 29:
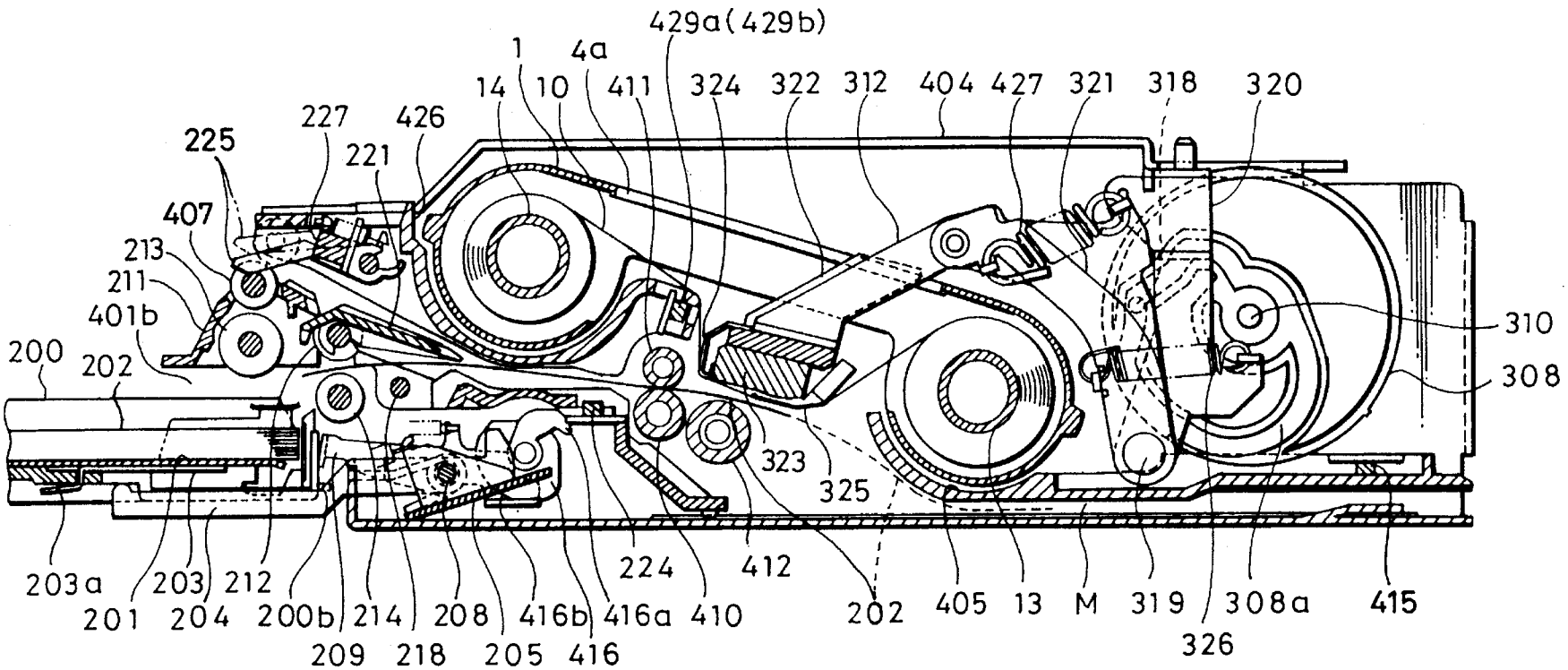

FIG. 29 is a diagram of operation of a head position H3 and a paper position P2 of the printer.

Figure 30:
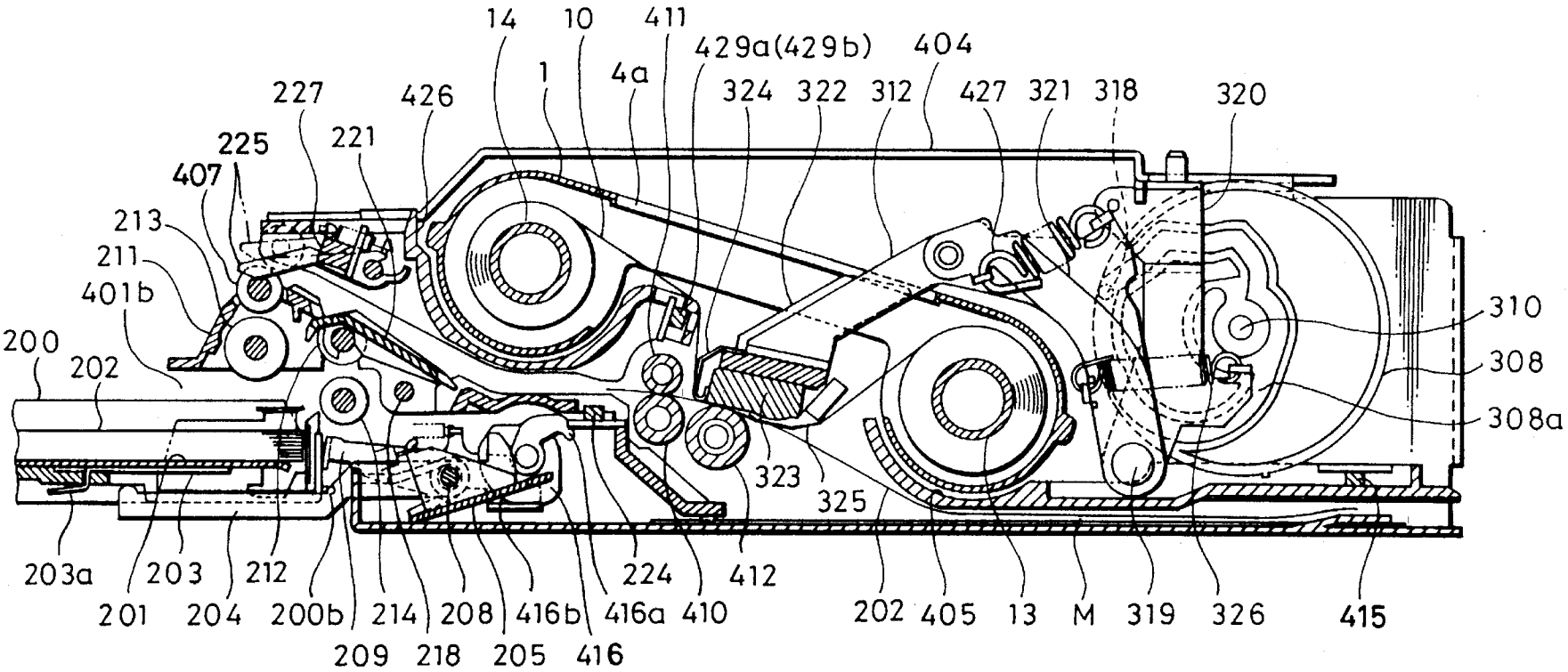

FIG. 30 is a diagram of operation of a head position H4 and the paper position P2 of the printer.

Figure 31:
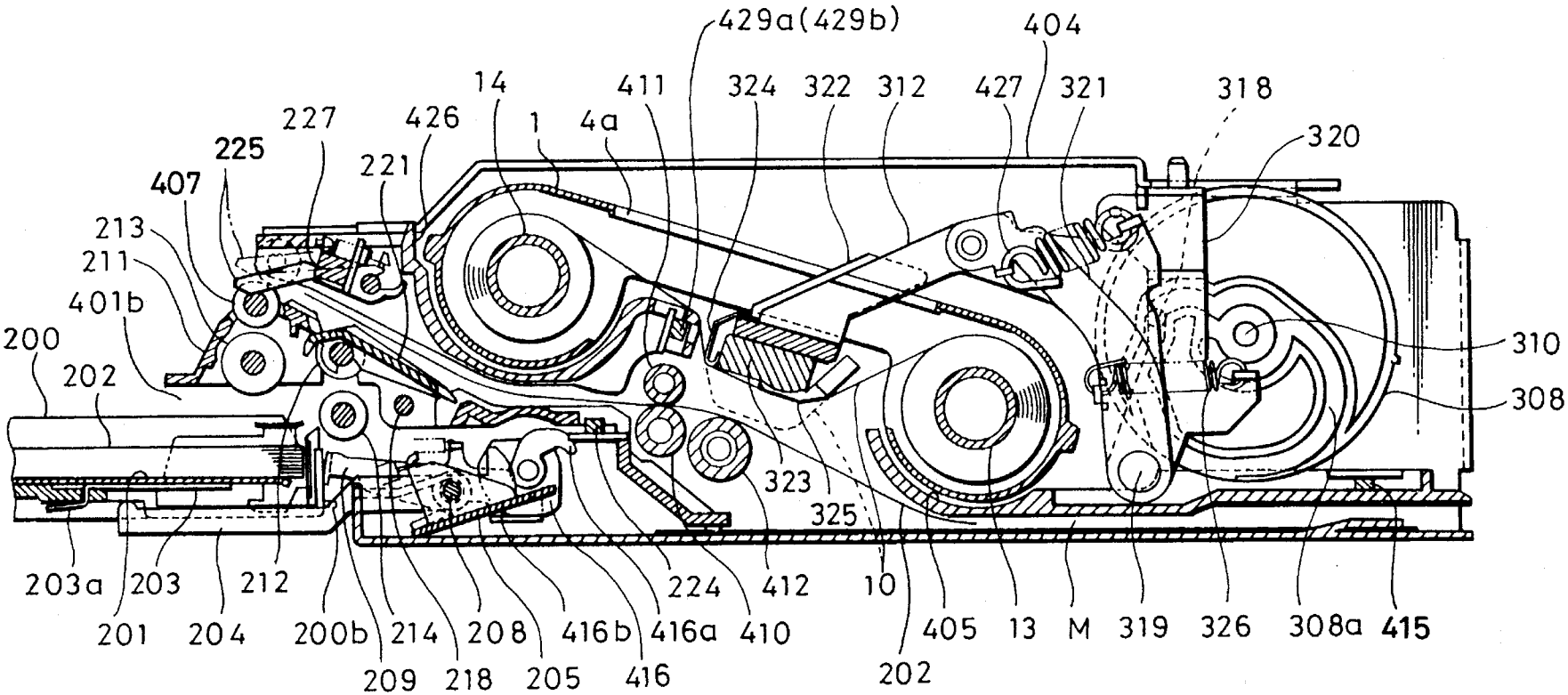

FIG. 31 is a diagram of operation of the head position H2 and the paper position P2 of the printer.

DETAILED DESCRIPTION OF PREFERRED EMBODIMENTS

An embodiment of the printer according to the present invention will hereinafter be explained with reference to the accompanying drawings by referring to a sublimation type thermal transfer system video printer as an example.

Figure 1:
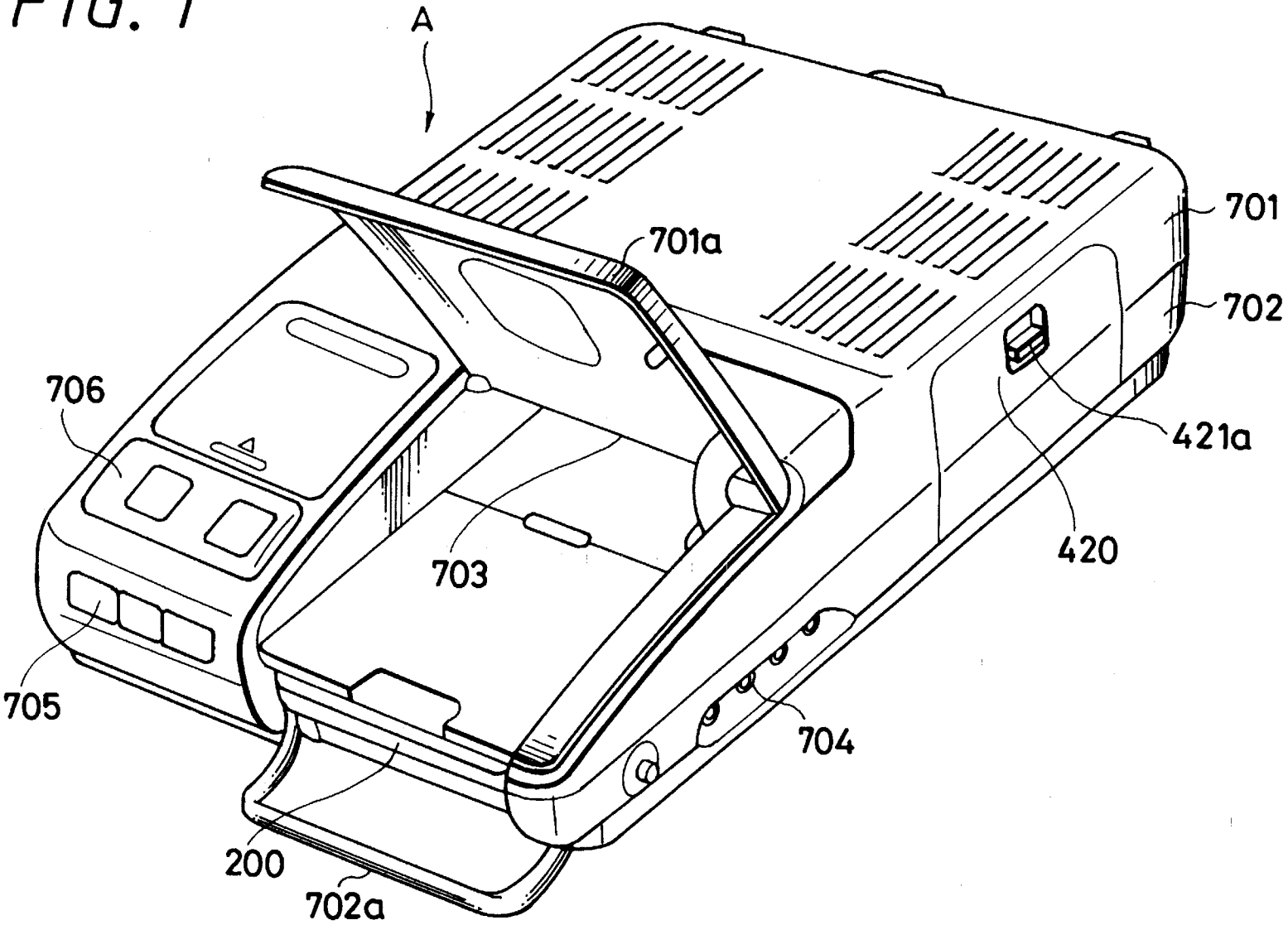
FIG. 1 is a perspective view of an appearance of a printer according to the present embodiment.
Figure 2:
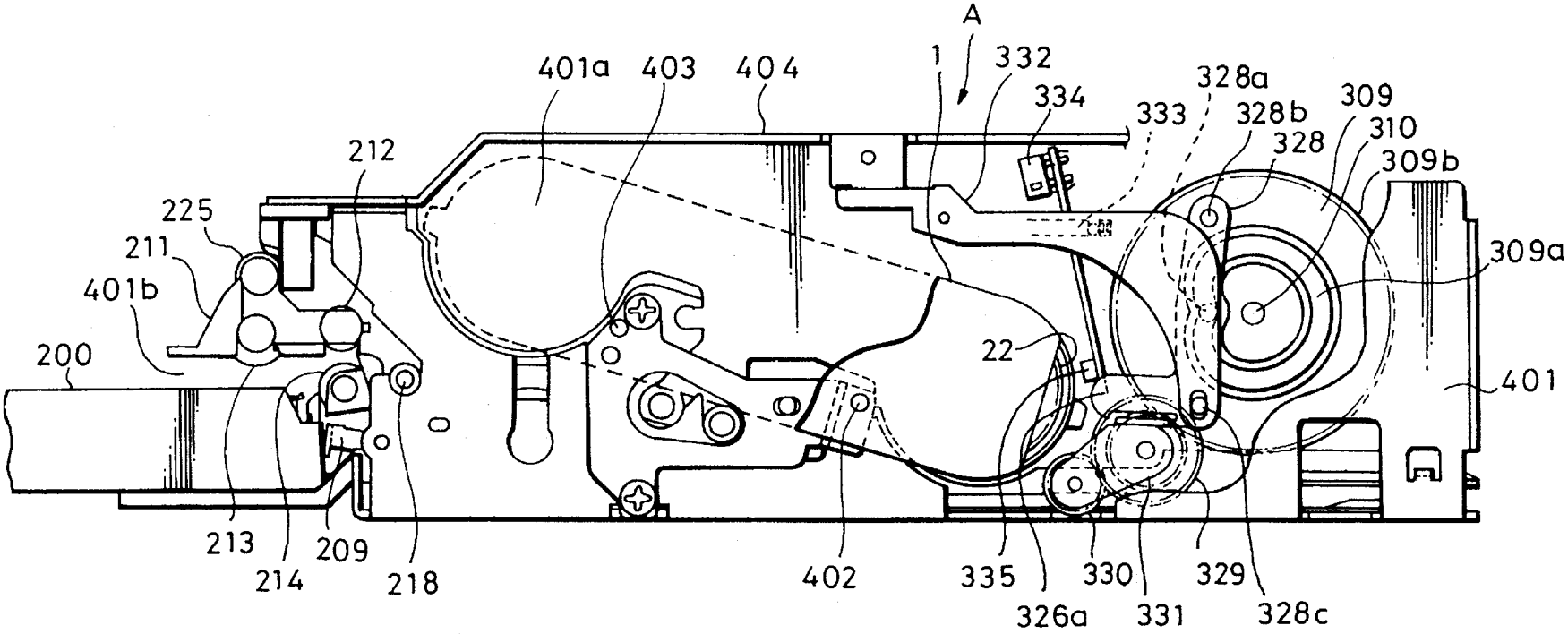
FIG. 2 is a partially cross-sectional, side view of the printer according to the present embodiment.
Figure 3:
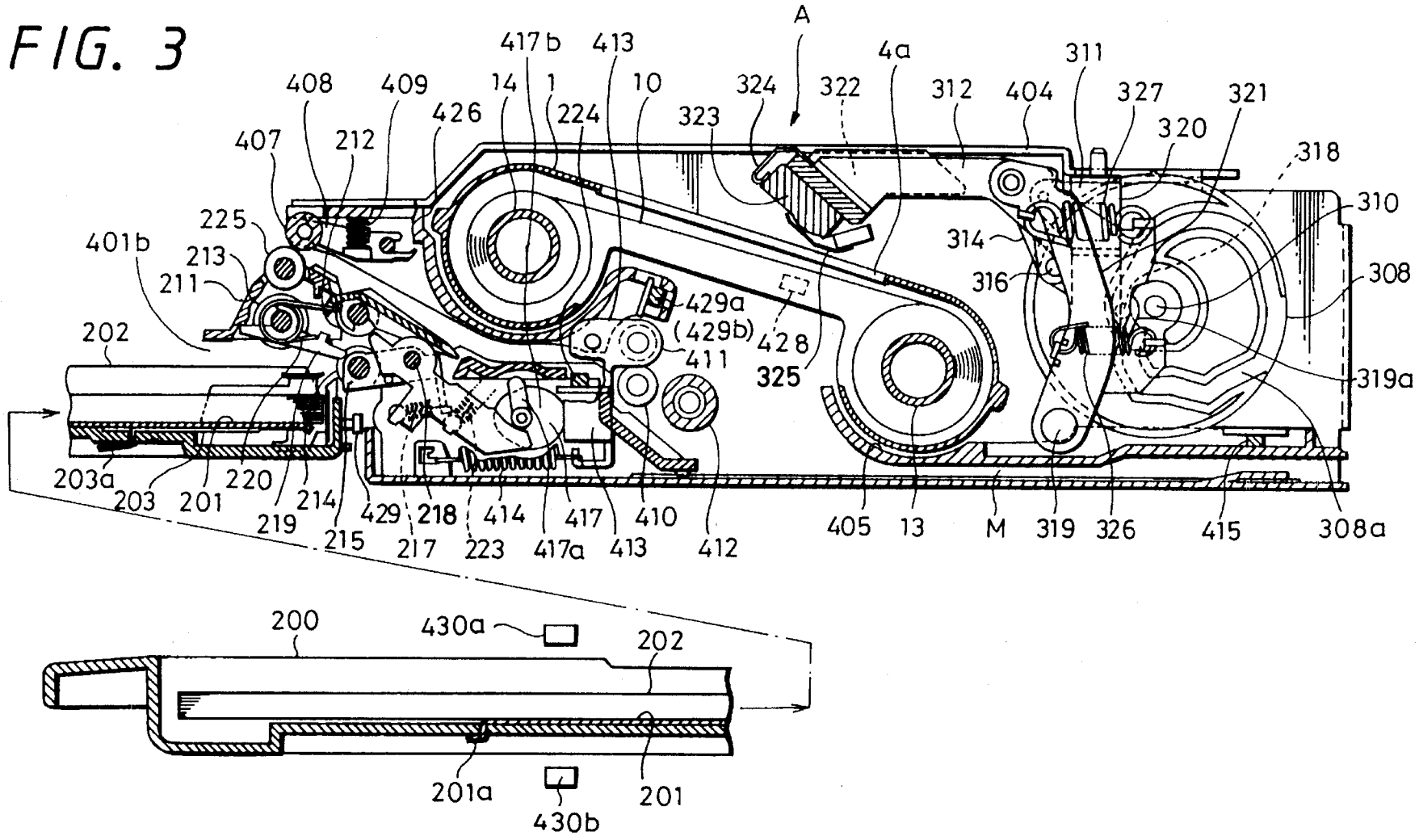
FIG. 3 is a cross-sectional view in which the printer according to the present embodiment is cut at a portion of a cam 308.
Figure 4:
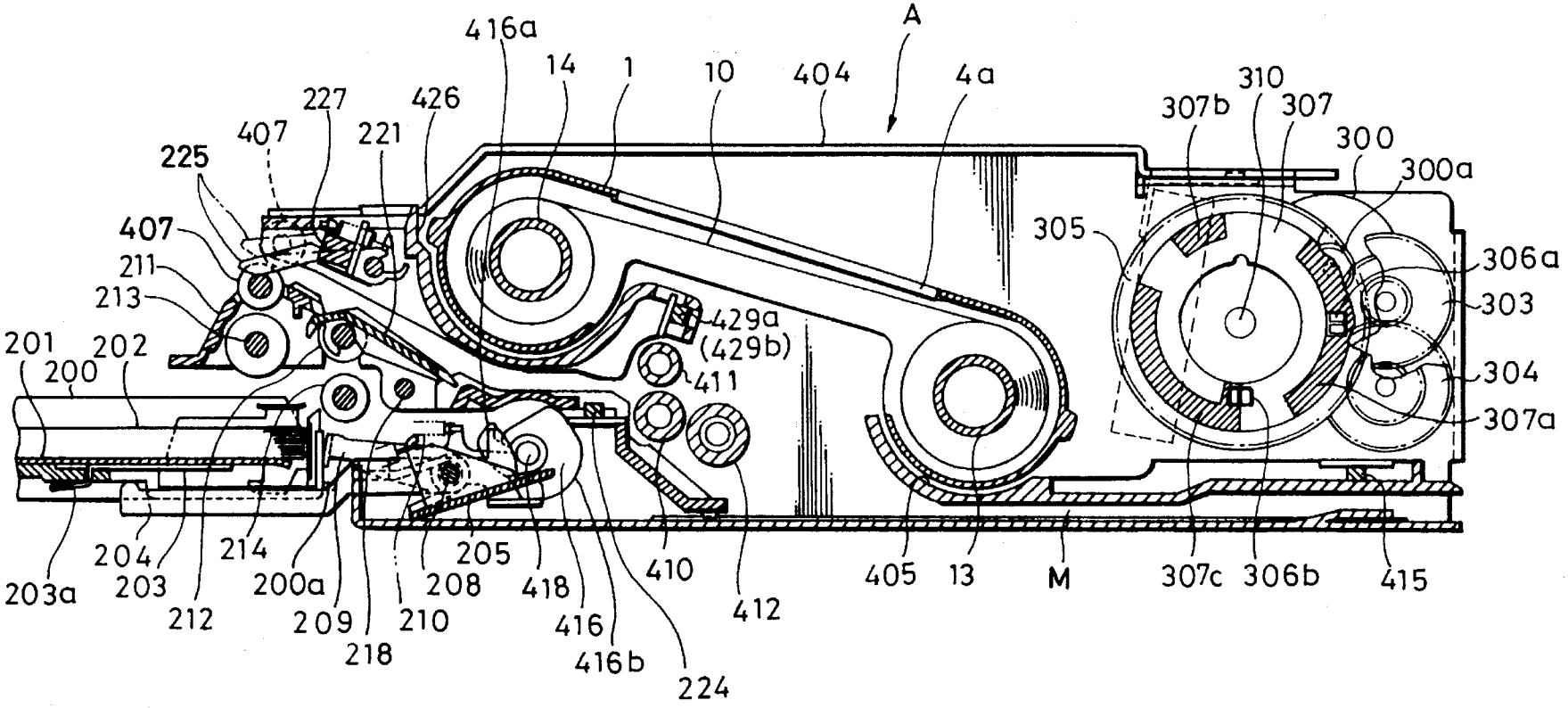
FIG. 4 is a cross-sectional view in which the printer according to the present embodiment is cut at a portion of a gear 305.
Figure 5:
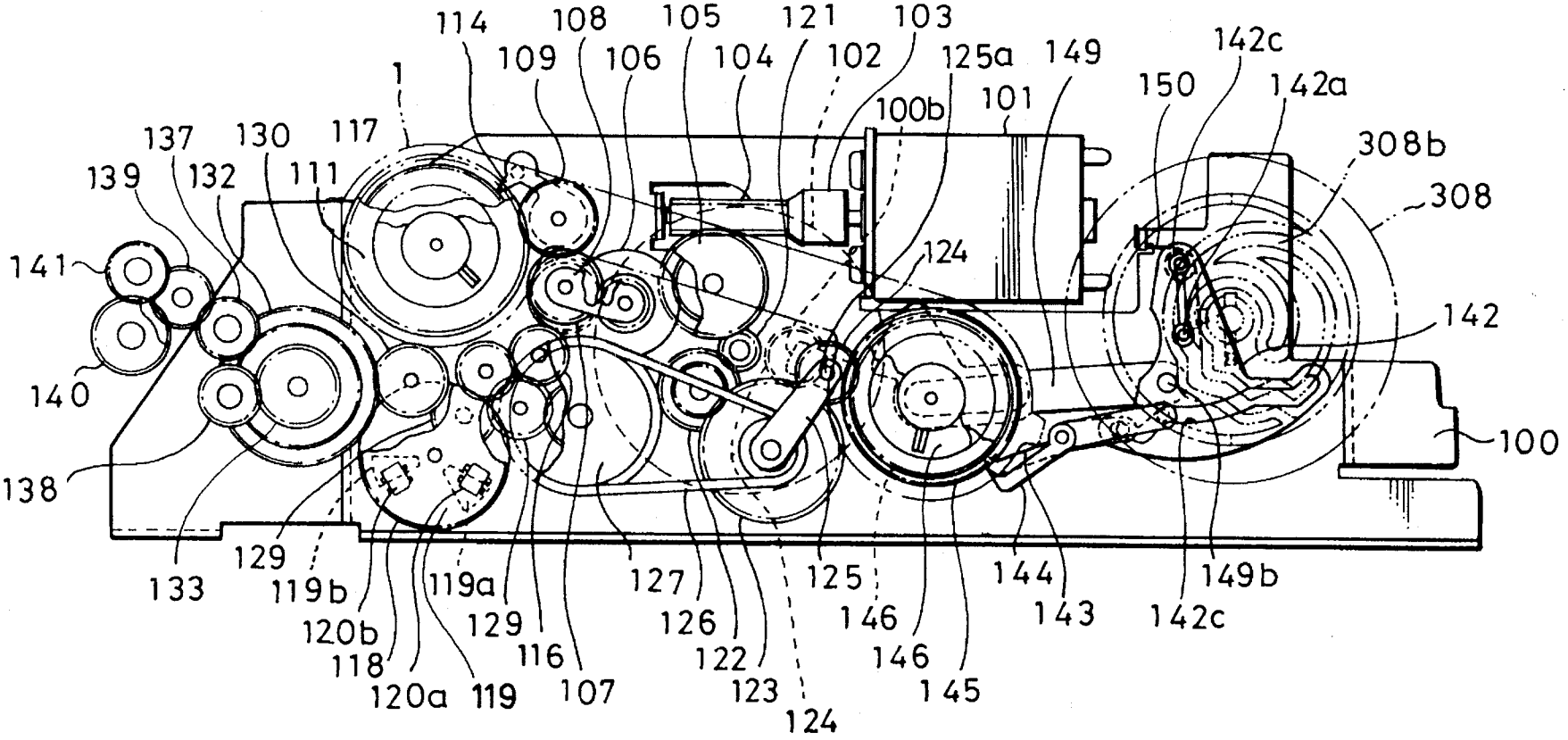
FIG. 5 is a side view of a transmission mechanism system to a T reel base, an S reel base and a change arm.

FIG. 1 is a perspective view of an appearance of a video printer of the present embodiment.

Reference letter A represents the whole of the video printer (hereinafter referred to simply as printer). A case body of the printer A is formed of an upper case 701 and a lower case 702 which are made of plastic. On a rear side of a side portion of the printer A, an ink ribbon door 420 for housing an ink ribbon cassette (hereinafter referred to as ribbon cassette), which will be described later, in the printer A is provided in such a manner that it can be opened and closed.

Also, on a front surface side of the printer A, there are provided a paper feeding tray 200, a paper delivering opening 703 for a printing paper, an input terminal 704 for a video signal, a power-source switch 705 and various kinds of switches 706 for determining a picture to be printed and designating the number of printing papers to be printed or the like.

The paper feeding tray 200 can be drawn and inserted by opening a paper door 702*a* of the lower case 702 and a paper delivering cover 701*a* of the upper case 701.

FIGS. 2, 3, 4 and 5 are different cross-sectional side views of cutting portions of the printer A. A chassis 401 which is bent so as to have a shape of a letter U is provided therein. A cover plate 404 is fitted to an upper opening portion of the chassis 401, and a bracket 100 and a rear-surface bracket 301 are fitted to side surfaces thereof. In the figures, a ribbon cassette 1 is housed through a side-surface opening portion 401*a* of the chassis 401, and the above-mentioned paper feeding tray 200 is loaded through a front-surface opening portion 401*b* in such a manner that it can be freely attached and detached.

Into a rectangular aperture through a bottom surface of the paper feeding tray 200, a paper feeding plate 201 and clicks 201*a* and 203*a* of a pair of left and right holding clicks 203 are inserted. The paper feeding plate 201 and a pair of the holding clicks 203 are rotated by a paper feeding arm 204 (see FIG. 4) rotated by a cam, which will be described later. The respective clicks 201*a* and 203*a* are used as fulcrums to press an end portion of a printing paper 202 in the paper feeding tray 200 on a paper feeding roller 213. Also, the paper feeding tray 200 is guided by a rail (not shown) and loaded at a predetermined position in the printer.

While a locking click 209 is rotated by operation of the cam, which will be described later, during a paper feeding operation, the locking click 209 is engaged with an aperture 200*a* of the paper feeding tray 200 to thereby prevent the paper feeding tray 200 from being drawn.

If roughly classified, the printer A as described above is formed of an ink ribbon mechanism using as a drive source a DC motor for searching a head of an ink ribbon in the ribbon cassette 1 and for taking up and rewinding the ink ribbon during a printing operation, a printing-paper feeding and delivering mechanism using as a drive source a stepping motor for feeding the printing paper in the tray 200 to a printing position and drawing the printing paper, which has been subjected to a printing processing, through the paper delivering opening 703 and a head mechanism using as a drive source a DC motor for performing the printing processing by a line type thermal head (hereinafter referred to simply as head).

Hereinafter, the above-mentioned ink ribbon mechanism, printing-paper feeding and delivering mechanism and head mechanism will successively be explained.

Figure 6:
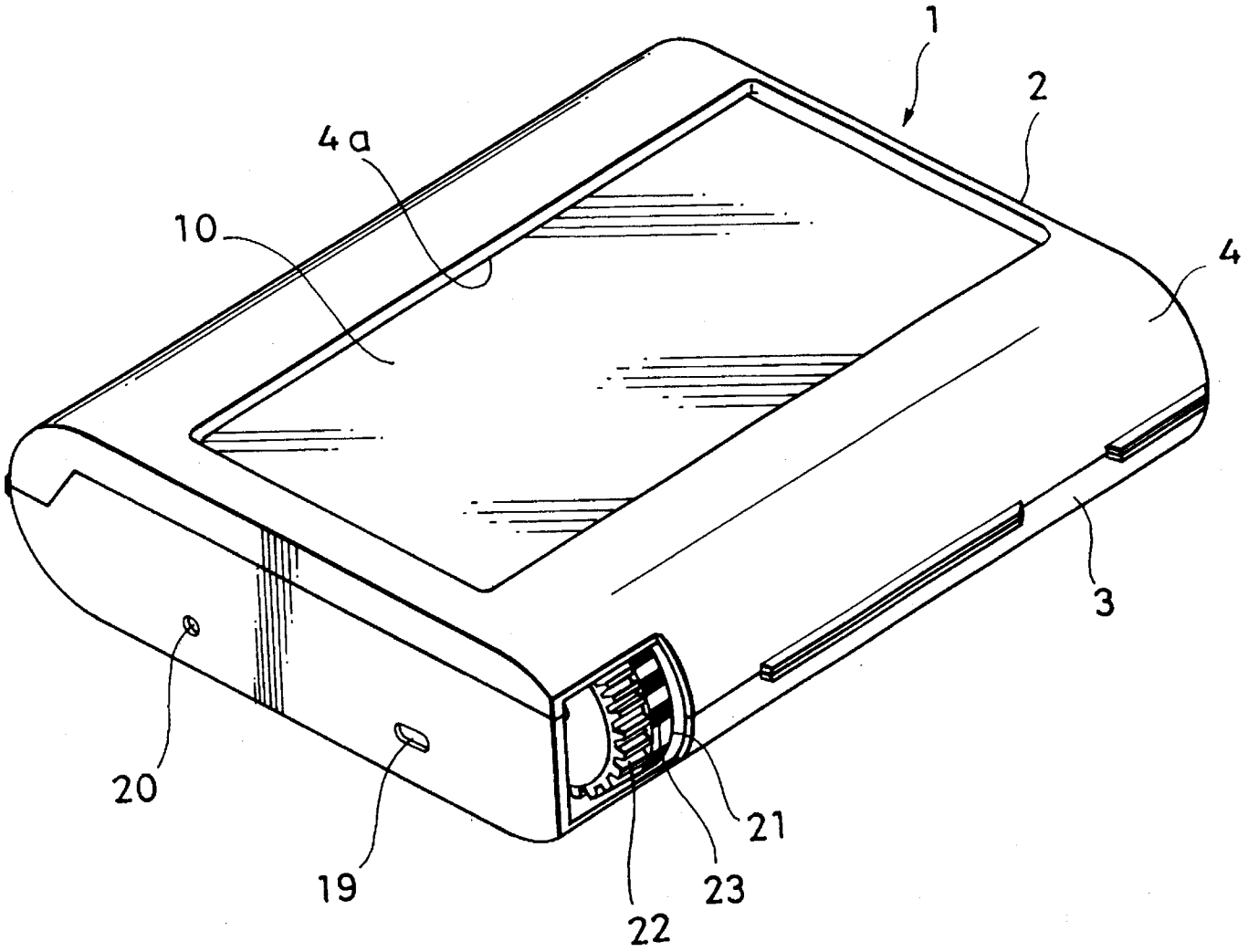
FIG. 6 is a perspective view of a ribbon cassette.
Figure 7:
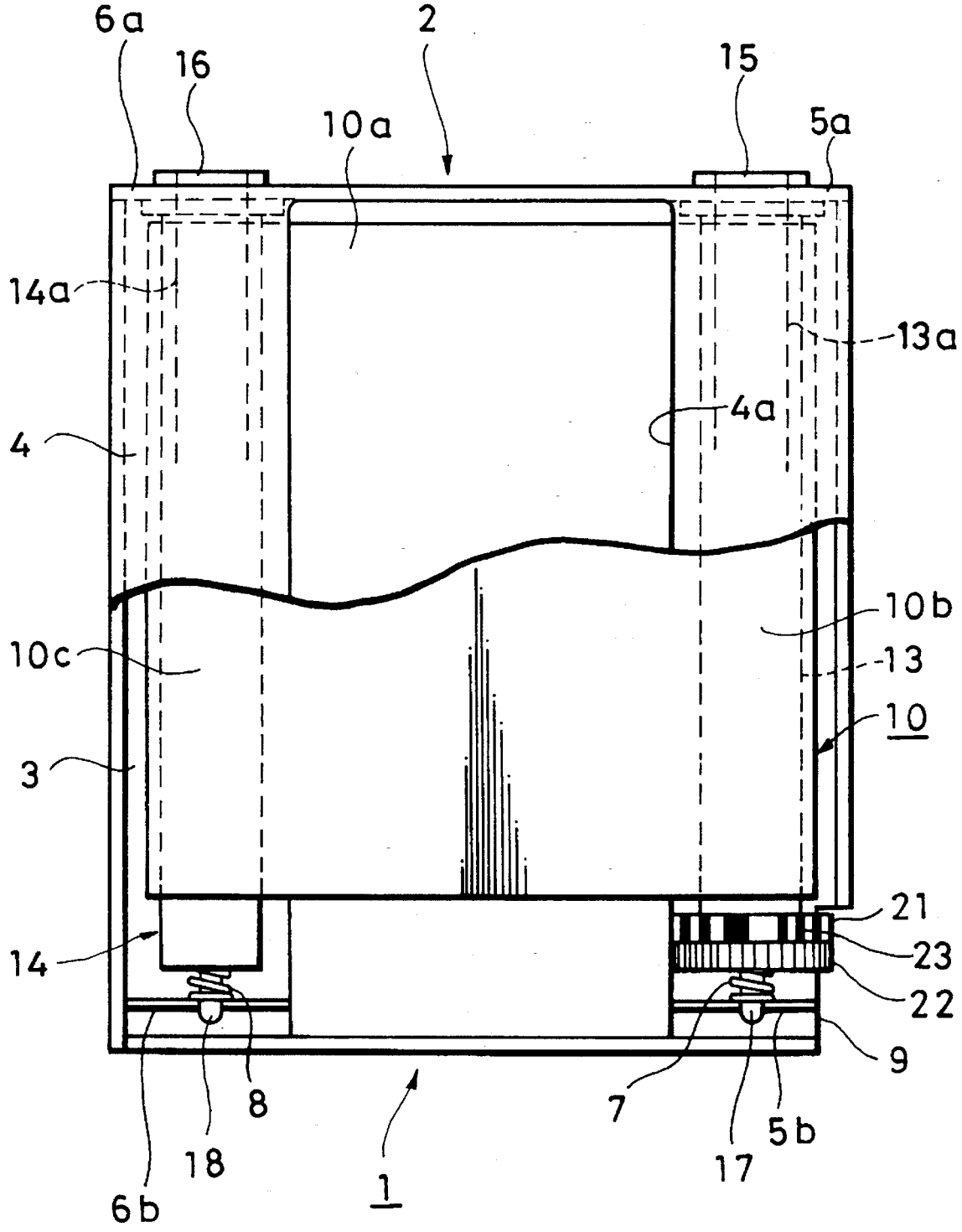
FIG. 7 is a partially cross-sectional, plan view of the ribbon cassette.
Figure 8:
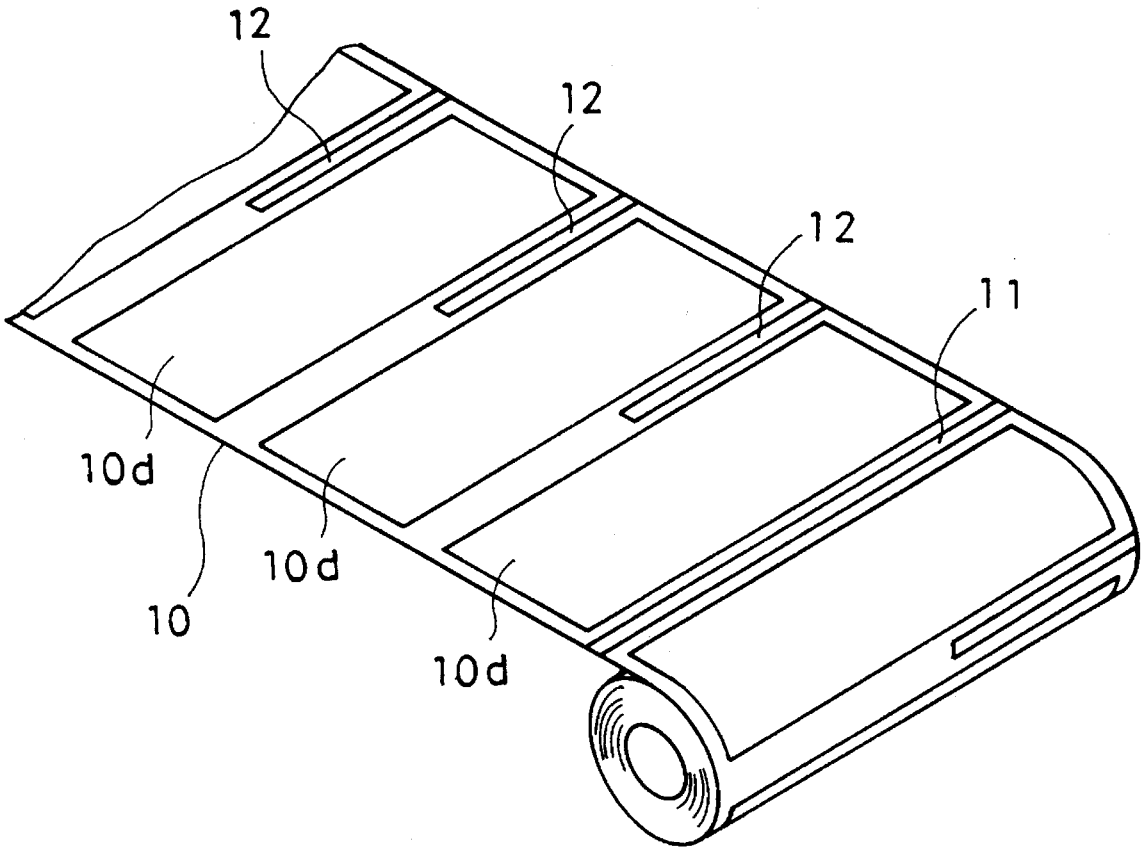
FIG. 8 is a perspective view of an ink ribbon.

The ribbon cassette 1 for use in the present invention will be explained in detail with reference to FIGS. 6 to 8. A cassette body 2 of the ribbon cassette 1 is formed so as to have a shape of such a case that a lower case 3 made of synthetic resin and an upper case 4 made of synthetic resin have a rectangular opening at a center portion thereof and an ink ribbon 10*a* to be used of an ink ribbon 10 is exposed through an opening portion 4*a*. One pair of bearing portions 5*a* and 5*b* formed by the lower case 3 and the upper case 4 rotatably support one end portion 15 and a shaft end 17 of a supply spool 13 around which an unused ribbon 10*b* is wound, and the other pair of bearing portions 6*a* and 6*b* rotatably support an end portion 16 and a shaft end 18 of a take-up spool 14 for taking up a used ribbon 10*c*.

Also, the above-mentioned supply spool 13 and the take-up spool 14 are biased by compression coil springs 7 and 8 toward sides of one bearing portions 5*a* and 6*a*, respectively. A code ring 21 is rotatably fitted to the supply spool 13 so as to be coaxial relative to the supply spool 13. The code ring 21 has on an outer periphery thereof a gear portion 22 and an information code 23 indicating information such as kinds, sensitivity, number or the like of the ink ribbon 10. Even in a stop state of the supply spool 13, the code ring 21 can be rotated by driving the gear portion 22 from the outside of the ribbon cassette 1.

On the other hand, when the code ring 21 does not receive any force from the outside of the ribbon cassette 1, it is rotated by a friction force between the supply spool 13 and the code ring 21 in a similar way to rotation of the supply spool 13. In the ink ribbon 10, a header mark 11 indicating a writing position of the ribbon upon a printing is printed over an entire width of the ink ribbon 10, and a patch mark 12 indicating a writing position of each color ribbon 10*d* in case of a multi color ribbon is printed over a half width of the ink ribbon 10. Also, the cassette body 2 is provided with an aperture 19 and an aperture 20, which are engaged with cassette pins 402 and 403 to thereby position the cassette body when the cassette body is loaded on the printer.

Figure 9:
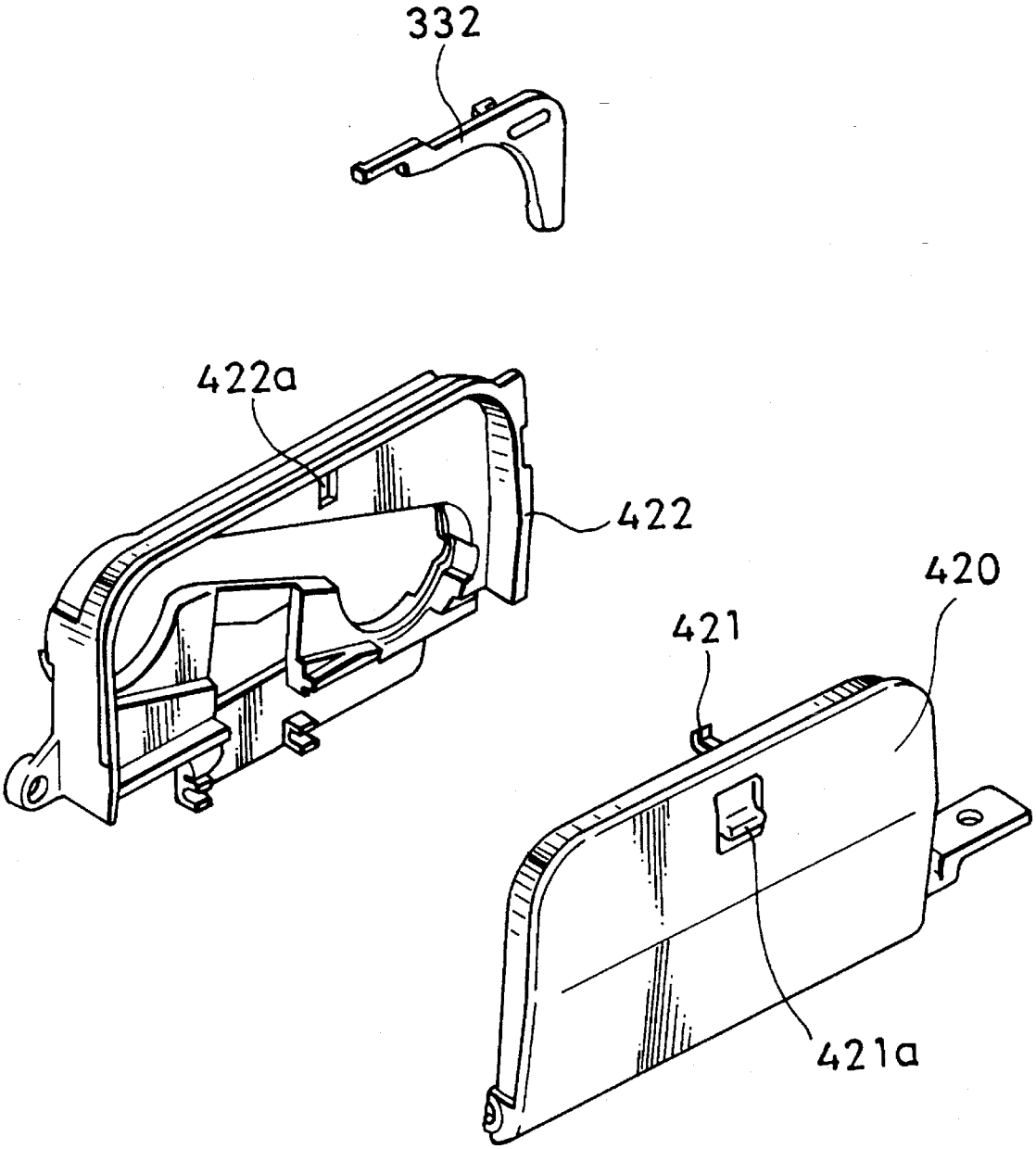
FIG. 9 is a perspective view of a ribbon door and a ribbon-door holder.
Figure 10:
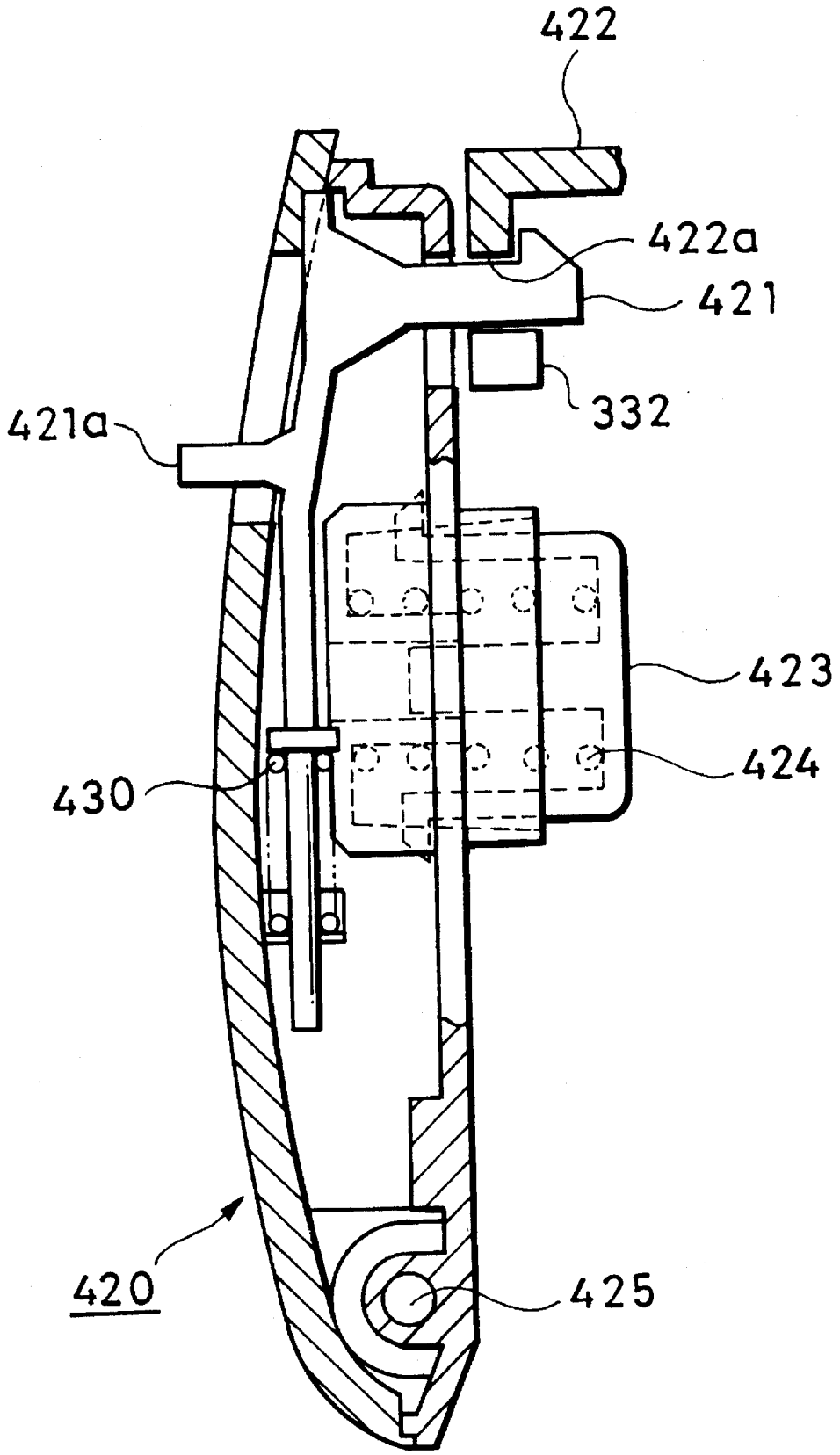
FIG. 10 is a cross-sectional view of the ribbon door.

Explanation about the ribbon door 42:

A portion through which the ribbon cassette 1 is loaded on and unloaded from the printer will be explained with reference to FIGS. 9 and 10. An entrance guide 426 is provided at the printer-front-surface opening portion 401*a*. The ribbon door 420 is rotatably fitted to the entrance guide 426 about a shaft 425. A locking click 421 is provided at the ribbon door 420. The click 421 is engaged with an aperture 422*a* of a ribbon-door holder 422 to thereby close the ribbon door 420. The click is biased by a spring 430 so as not to come out of the aperture. By pushing an external portion 421*a* of the locking click 421 down, the engagement of the locking click 421 and the aperture 422*a* is released to open the ribbon door 420.

The ribbon cassette 1 is guided by the guide 426, inserted into and loaded on a cassette housing portion 405. If the ribbon door 420 is closed under this state, then the ribbon door 420 is locked by the locking click 421 and the loaded ribbon cassette 1 is biased in a direction to the inside of the printer by a ribbon holder 423 biased by a spring 424 projecting toward a rear-surface side of the ribbon door 420.

Explanation about a locking lever of the ribbon door 420:

During the printing, in order to prohibit ejection of the ribbon cassette 1, a locking lever 332 fitted to the ribbon door 420 is positioned on the side below the locking click 421 to restrict a downward movement of the locking click 421 by the action of a cam described later on. Therefore, during the printing, the external portion 421*a* of the locking click cannot be pushed down and the locking click 421 is prevented from being released, so that the ribbon door 420 cannot be opened, whereby the ribbon cassette 1 cannot be ejected.

Next, there will be explained an operation of the ink ribbon mechanism by the DC motor as a drive source.

First, there will be explained a portion which is driven by rotation of a motor 101. The motor 101 can be rotated normally and reversely. A transmission course of rotation thereof is switched between a normal rotation thereof and a reverse rotation thereof which are based on operation of a pendulum gear 107. The rotation is transmitted to the take-up spool 14 of the ribbon cassette 1 through a take-up reel base 111 (hereinafter referred to as T reel base 111) by one direction of rotation thereof and to a cam 416 of a printing-paper carrying mechanism by the other direction of rotation thereof.

Explanation about transmission of rotation to the take-up spool 14:

The rotation of the motor 101 is transmitted to a worm 104 through a worm base 103 forced onto a shaft of the motor 101 and reduced by a two-stage gear 105 and a two-stage gear 106. A friction force is generated by a spring or the like (not shown) between the pendulum gear 107 and a pendulum-gear arm 108. Therefore, if the two-stage gear 106 is rotated in the clockwise direction in the figure, then the pendulum-gear arm 108 is also rotated in the same direction to engage the pendulum gear 107 with a gear 109, whereby the rotation is transmitted to a gear 110. The gear 110 is a part having torque limiting function and constructing the T reel base 111.

Figure 11:
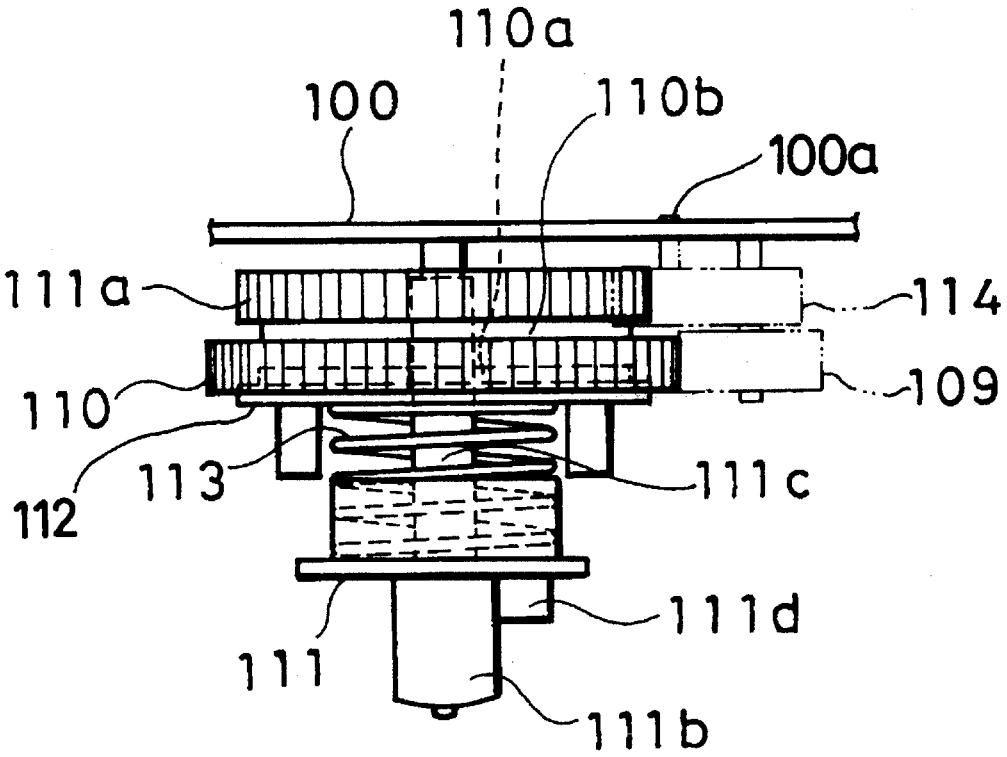
FIG. 11 is a detailed diagram of the T reel base.

A cross section of the T reel base 111 is shown in FIG. 11. Felts 110*a* and 110*b* are respectively bonded to front and rear surfaces of the gear 110 and can be rotated together with a pressure plate 112 using a hollow shaft 111*c* as a shaft. An engaging portion 111*b* which is a torque transmission unit between a gear portion 111*a* and the take-up spool 14 of the ribbon cassette 1 is forced into the shaft 111*c* to thereby rotate the gear portion 111*a*, the engaging portion 111*b* and the shaft 111*c* integrally. The pressure plate 112 is engaged with the engaging portion 111*b* at their convex-concave portions to thereby rotate the former in the same direction as the engaging portion 111*b*.

A compression coil spring 113 is disposed between the engaging portion 111*b* and the pressure plate 112 and puts pressure to the felt 110*a* and the pressure plate 112 and the felt 110*b* and the gear portion 111*a* to generate a friction force. When the gear 110 is rotated, a torque generated from the friction force is transmitted to the engaging portion 111*b*. However, even if a torque exceeding the torque generated by the friction force is intended to be transmitted to the engaging portion 111*b*, slips are generated between the felt 110*a* and the felt 110*b* and respective counterparts thereof, so that the torque exceeding the torque generated by the friction force cannot be transmitted.

Also, an outside diameter of the engaging portion 111*b* is engaged with a bore of an engaging portion 14*a* of the take-up spool 14 and positions a rotation shaft of the take-up spool 14. A convex portion 111*d* of the engaging portion 111*b* is engaged with the engaging portion 14*a* to transmit rotation to the take-up spool 14.

Figure 12:
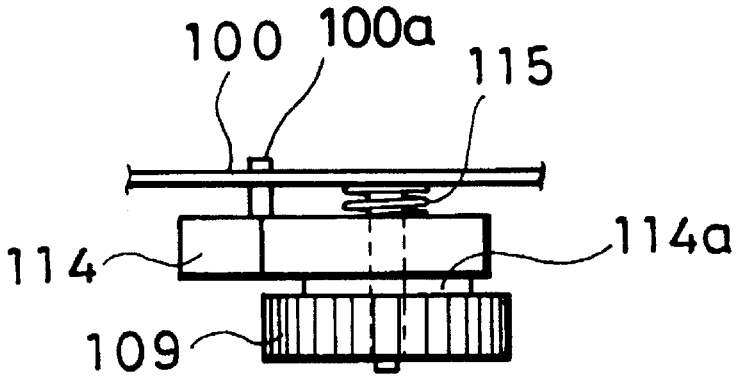
FIG. 12 is a detailed diagram of a gear 109.

Explanation about a reverse-rotation preventing click of the T reel base 111:

Also, a click 114 is rotatably fitted to the gear 109 on the same plane as the gear portion 111*a*. A felt 114*a* is bonded to the click 114 as shown in FIG. 12. A compression coil spring 115 biases the click to thereby generate a friction force between the felt 114*a* and the gear 109, so that the click 114 is also rotated in the same direction as the rotation direction of the gear 109. If the two-stage gear 106 is rotated in the clockwise direction in the figure, then the gear 109 is rotated in the clockwise direction in the figure through the pendulum gear 107 and the click 114 is also rotated in the same direction. The click 114 is restricted in rotation amount by an aperture 100*a* of the bracket 100 and hence is prevented from being rotated unnecessarily. Function of the click 114 will be described later.

Explanation about transmission of rotation to a paper position:

If the two-stage gear 106 is rotated in the counterclockwise direction in the figure, then the pendulum-gear arm 108 is rotated in the same direction as the two-stage gear 106 to engage the pendulum gear 107 with a gear 116.

Explanation about the reverse-rotation preventing click:

At this time, if the take-up spool 14 of the ribbon cassette 1 is reversely rotated by vibration, static electricity or the like of the printer and hence slack of the ribbon is about to be produced, then the T reel base 111 is also reversely rotated and hence the gear 109 is about to be rotated in the counterclockwise direction in the figure. However, since the click 114 is similarly rotated in the same direction as the gear 109, the click 114 is engaged with the gear portion 111*a* of the T reel base 111 and prevents the T reel base 111 from being rotated to thereby prevent the slack of the ribbon. (When the pendulum gear 107 is engaged with the gear 109, the reversal rotation of the T reel base 111 is transmitted to respective gears to intend the worm 104 to be rotated. However, since the worm 104 is a single worm, the worm 104 is not rotated by rotation of the two-stage gear 105. Therefore, the T reel base 111 cannot be reversely rotated, and the slack of the ribbon is not produced.)

Continued explanation about movement of the paper position:

The rotation of the gear 116 is transmitted to a gear 118 through the gear 117. A reflection seal 119 is bonded to the gear 118, and a rotation position thereof is checked by two optical sensors 120*a* and 120*b*. Relation between the gear 118 and the sensors 120*a* and 120*b* is shown in FIG. 13. The reflection seal 119 is formed of an aluminum plate having a high optical reflectance at its surface or the like, where two black portions 119*a* and 119*b* having low optical reflectance are printed. The sensors 120*a* and 120*b* detect the black portions and an aluminum surface as shade and light, respectively.

Figure 13A:
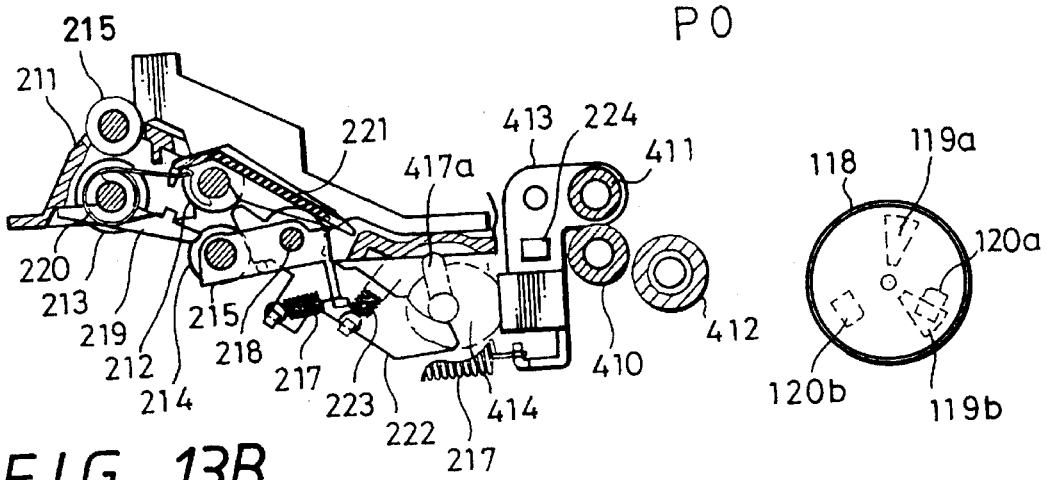
FIG. 13A to 13C are operational diagrams of a relation between a sensor and a paper position.
Figure 13B:
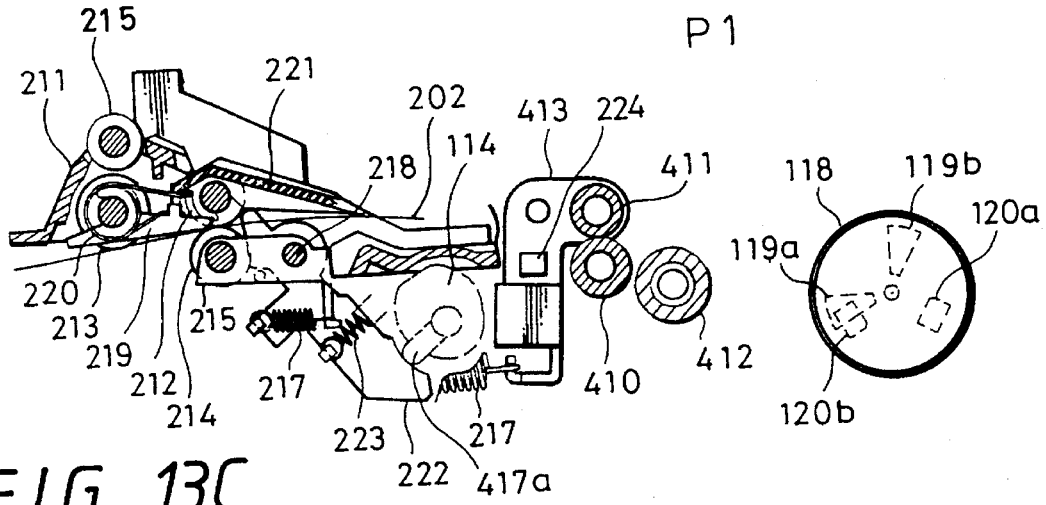
Figure 13C:
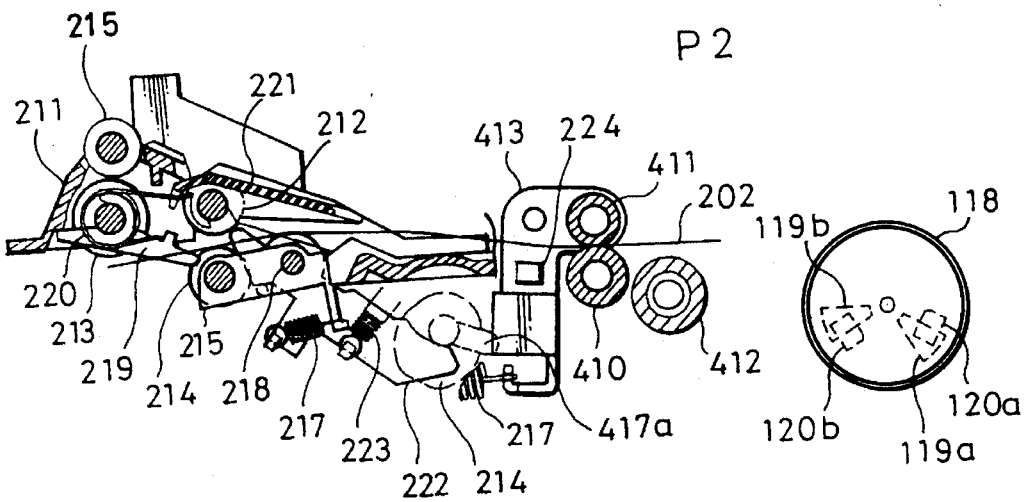

The gear 118 can be rotated by function of the pendulum gear 107 only in the counterclockwise direction in the figure, and rotation thereof is stopped at a position where the sensors 120*a* and 120*b* detect the shade and the light, respectively. This position is referred to as a paper position 0 (hereinafter referred to as P0) (FIG. 13A). Next, the gear 118 is rotated by 120°, and the rotation thereof is stopped at a position where the sensors 120*a* and 120*b* detect the light and the shade, respectively. This position is referred to as a paper position 1 (hereinafter referred to as P1) (FIG. 13B). Subsequently, the gear 118 is rotated by 120°, and the rotation thereof is stopped at a position where both of the sensors 120*a* and 120*b* detect the shade. This position is referred to as a paper position 2 (hereinafter referred to as P2) (FIG. 13C). If the gear 118 is rotated by a further 120°, then the sensors detect the P0 position again. Therefore, the gear 118 circulates through the respective positions of P0, P1, P2, P0, . . . , and hence can be moved to and stopped at an optional position.

Figure 14:
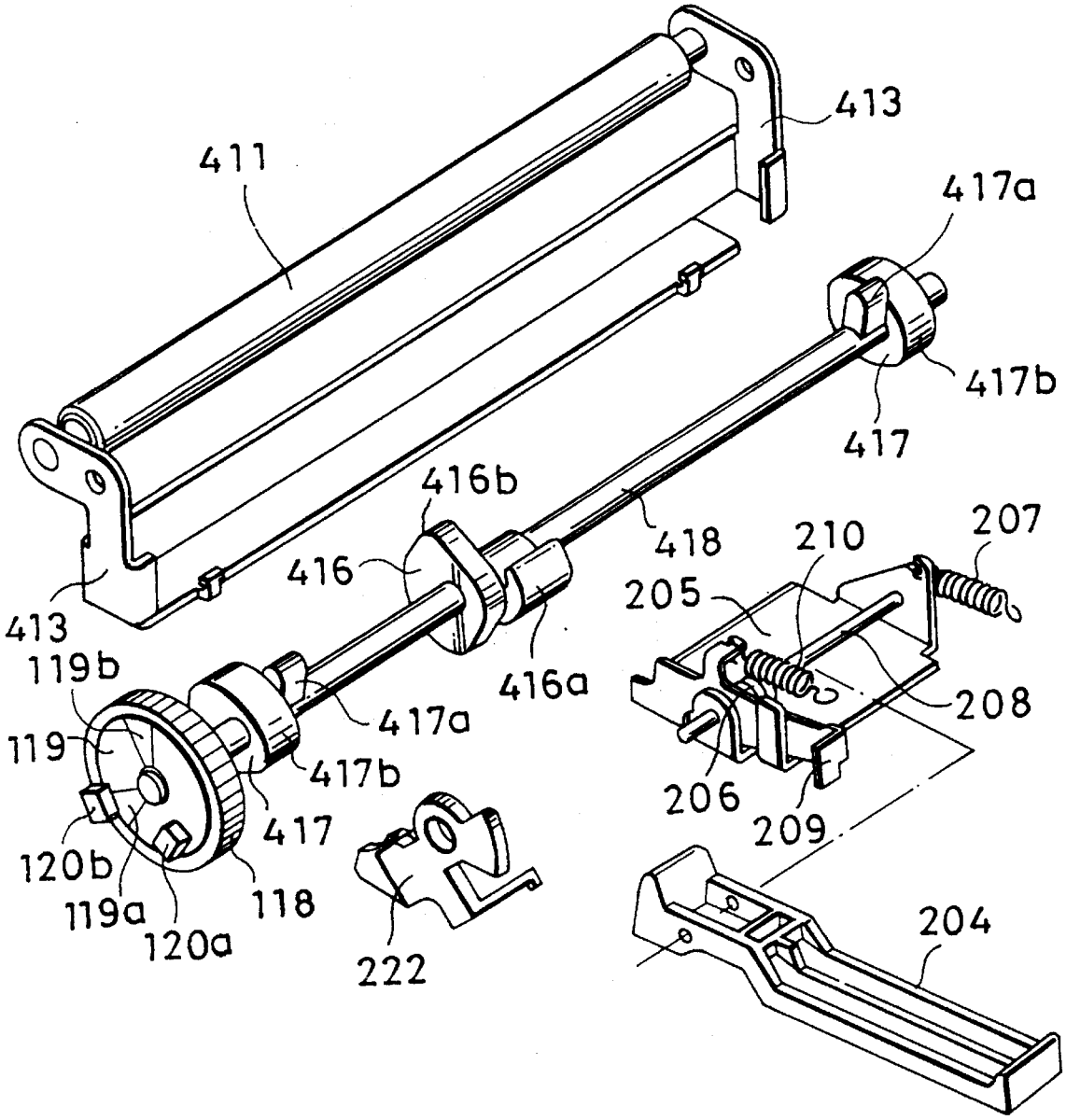
FIG. 14 is an exploded and perspective view of a paper feeding cam and a releasing cam and counterparts thereof.

Movement of the cam and its counterpart at the paper position:

As shown in FIG. 14, the gear 118 is connectably rotated by a shaft 418 which is supported by the chassis 401 for a paper feeding cam 416 and a pair of releasing cams 417 to be rotatably supported. As shown in FIG. 14, a pressing plate 205 and the locking click 209 are rotated by a cam plane 416*a* of the paper feeding cam 416 and a cam plane 416*b* thereof, respectively. A releasing lever 222 and a pinch-roller arm 413 are rotated by a cam plane 417*a* of the releasing cam 417 and a cam plane 417*b* thereof, respectively.

Explanation about function of the paper feeding cam 416:

As shown in FIG. 14, the pressing plate 205 is rotatably fitted to a shaft 208 fitted to the paper feeding arm 204 and the locking click 209. The pressing plate 205 and the locking click 209 are respectively biased by a spring 207 and a spring 210 in the direction of the paper feeding cam 416. The paper feeding arm 204 is pressed by a torsion coil spring 206 on the pressing plate 205 and also restricts a relative position. When the pressing plate 205 is rotated by the cam plane 416*a* of the paper feeding cam 416, the paper feeding arm 204 is similarly rotated to bring the paper feeding plate 201 upward, and the printing paper 202 in the paper feeding tray 200 is brought in contact with the paper feeding roller 213.

Further, when the pressing plate 205 is rotated, the paper feeding arm 204 is in contact with the paper feeding roller 213 and restricted in movement by the paper feeding plate 201 whose rotation has become impossible. A relative difference in rotation is caused between the pressing plate 205 and the paper feeding arm 204 to generate flexure in the spring 206. The paper feeding arm 204 puts a pressure on the paper feeding plate 201 by a spring force of the spring 206 to press the printing paper 202 on the paper feeding roller 213.

Also, the locking click 209 is rotated by the cam plane 416*b* of the paper feeding cam 416 and then engaged with the aperture 200*a* of the paper feeding tray 200 to thereby prevent the paper feeding tray 200 from being removed.

Explanation about movement of the releasing cam 417:

The pinch-roller arm 413 rotatably supported by the chassis 401 supports a pinch roller 411 rotatably so that the pinch roller 411 is pressed on a capstan 410 by a spring 414. The pinch-roller arm 413 is rotated by operation of the releasing cam 417 to release the pressing of the pinch roller 411 on the capstan 410.

The releasing lever 222 is rotatably fitted to a shaft 218 fitted to the chassis 401 and biased by a spring 223 in the direction of the releasing cam 417. The releasing lever 222 is rotated by the releasing cam 417 and rotates a rotating plate 215, which supports a separating roller 214 rotatably, through a spring 217 to thereby press the separating roller 214 on a paper feeding roller 212 and open a shutter 221 which is rotatably fitted to a shaft of the paper feeding roller 212 and closed by a spring 220.

Also, the spring 220 biases a holding lever 219 rotatably fitted to the paper feeding roller 213. A standby position of the holding lever 219 is determined by restriction of a guide 211. There will be explained in detail later a driving method or the like of the paper feeding roller 212, the paper feeding roller 213 and the separating roller 214.

Next, there will be explained operation of a stepping motor for driving a printing-paper feeding and delivering mechanism.

A controlling circuit enables a stepping motor 02 to be rotated normally and reversely by angles of an optional multiple of a step angle peculiar to the motor. The stepping motor 102 carries the printing paper 202 in cooperation with the above-mentioned paper feeding cam 416 and releasing cam 417 and rotates a supply reel base 146 (hereinafter referred to as S reel base 146) in cooperation with a link 149, which will be described later, or the like.

Explanation about a paper carrying system:

Rotation of a pinion 121 forced onto a rotation shaft of the stepping motor 102 is reduced by a two-stage gear 122 and then transmitted to a gear pulley 123. A pendulum gear 124 is connected to the gear pulley 123 through a pendulum arm 125. operation of the pendulum gear 124 will be described later. Rotation of the gear pulley 123 is transmitted by a belt 126 to a gear pulley 127. The gear pulley 127 rotates the capstan 410 carrying the printing paper. The capstan 410 is a roller which is rotatably supported by the chassis 401 through a bearing (not shown) and whose surface is subjected to such a working that a friction coefficient thereof relative to the printing paper becomes large.

Figure 15:
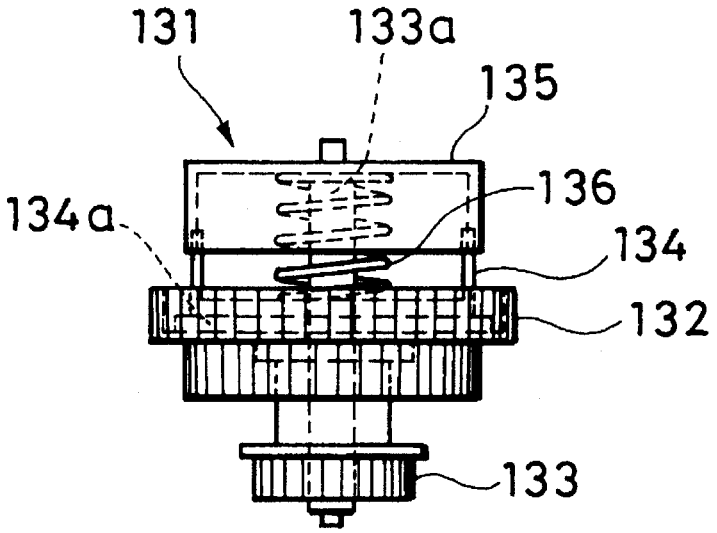
FIG. 15 is a detailed diagram of a two-stage gear 132.

The rotation of the gear pulley 127 is also transmitted to a two-stage gear 132 through a gear 129 and a gear 130. The two-stage gear 132 is a part constructing a paper feeding limiter 131 having a torque limiting mechanism shown in FIG. 15 which is a cross-sectional view thereof. The two-stage gear 132 and a pressure plate 134 to which a felt **134*a* is bonded employ a hollow shaft 133*a*, which is a part of a gear 133**, as a rotation shaft.

A holding plate 135 is forced into the shaft **133*a*, and the gear 133 and the holding plate 135 are integrally rotated. The holding plate 135 and the pressure plate 134** are rotated in the same direction by engagement thereof at respective convex and concave portions.

A compression coil spring 136 is disposed between the pressure plate 134 and the holding plate 135 and puts pressure to the two-stage gear 132 and the felt **134*a*, and the two-stage gear 132 and the felt 134*a* to generate a friction force. When the two-stage gear 132 is rotated, a torque produced by the friction force is transmitted to the gear 133. However, even if a torque exceeding the torque generated from the friction force is intended to be transmitted to the gear 133, slips are generated between the two-stage gear 132** and a counterpart thereof, so that the torque exceeding the torque generated by the friction force cannot be transmitted.

Rotation of the two-stage gear 132 is transmitted to a gear 137, a gear 139, a two-stage gear 140 and a gear 141. Rotation of the gear 133 is transmitted to a gear 138. Rotation of the gear 137, rotation of the gear 138, rotation of the two-stage gear 140 and rotation of the gear 141 are transmitted to the paper feeding roller 212, the separating roller 214, the paper feeding roller 213 and a paper delivering roller 225, respectively.

The paper feeding roller 212, the paper feeding roller 213 and the paper delivering roller 225 are rotatably supported by the guide 211 through a bearing, and the separating roller 214 is rotatably supported by the rotating plate 215 through a bearing.

Explanation about the rewinding of the ink ribbon:

Next, operation of the pendulum gear 124 will be explained.

A friction force is generated between the pendulum gear 124 and the pendulum arm 125 by a spring or the like (not shown). Therefore, while the pendulum arm 125 is rotated in the same direction as a rotating direction of the two-stage gear 122, a shaft **125*a* of the pendulum arm can be moved only within an aperture 100*b* of the bracket 100 to thereby restrict a rotation range of the pendulum arm 125. If the two-stage gear 122 is rotated in the clockwise direction in the figure, then the pendulum arm 125 is rotated in the counterclockwise direction and restricted in rotation by the aperture 100*b* to race the pendulum gear 124 (i.e., enable the gear 124 to rotate without driving anything). Next, if the two-stage gear 122 is rotated in the counterclockwise direction in the figure, then the pendulum arm 125 is rotated in the clockwise direction to engage the pendulum gear 124 with a gear 145 of the S reel base 146**.

Figure 16:
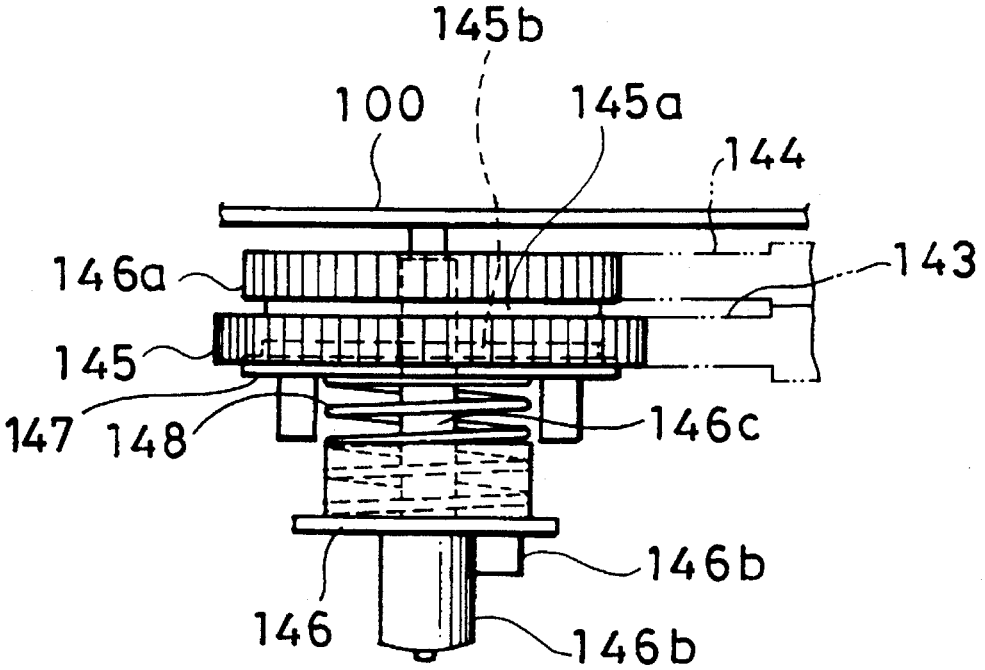
FIG. 16 is a detailed diagram of the S reel base.

Explanation about the S reel base:

Here, a cross section of the S reel base 146 will be explained with reference to FIG. 16.

The S reel base 146 has a torque limiting function. Felts **145*a* and 145*b* are respectively bonded to front and rear surfaces of the gear 145, which can be rotated together with a pressure plate 147 by using a hollow shaft 146*c* as a rotation shaft. An engaging portion 146*b*, which is a torque transmission unit between a gear portion 146*a* and the supply spool 13 of the ribbon cassette 1, is forced into the shaft 146*c* to thereby rotate the gear portion 146*a*, the engaging portion 146*b* and the shaft 146*c*** integrally.

The pressure plate 147 is engaged with the engaging portion **146*b* at their convex-concave portions to thereby be rotated in the same direction as the engaging portion 146*b*. A compression coil spring 148 is disposed between the engaging portion 146*b* and the pressure plate 47 and puts pressure on the felt 145*a* and the pressure plate 147, and the felt 145*b* and the gear portion 146*a* to generate friction forces. When the gear 145 is rotated, a torque produced from the friction force is transmitted to the engaging portion 146*b*. However, even if a torque exceeding the torque generated by the friction force is intended to be transmitted to the engaging portion 146*b*, slips are generated between the felt 145*a* and the felt 145*b* and respective counterparts thereof, so that the torque exceeding the torque generated by the friction force cannot be transmitted. An outside diameter of the engaging portion 146*b* is engaged with a bore of an engaging portion 13*a* of the supply spool 13 and positions a rotation shaft of the supply spool 13. A convex portion 146*d* of the engaging portion 146*b* is engaged with a concave portion 13*b* of the engaging portion 13*a*** to transmit rotation.

Continued explanation about the rewinding of the ribbon:

The pendulum gear 124 transmits rotation through the above-mentioned operation thereof to the gear 145 to rotate the S reel base 146 and rotate the supply spool 13. Therefore, the ribbon 10 can be taken up (rewound) around the supply reel 13. But, a link 149 may be moved causing a head portion **149*a* of the link 149 to narrow a movable range of the shaft 125*a* of the pendulum arm to make it impossible to engage the pendulum gear 124 with the gear 145, whereby the pendulum gear 124 races (i.e., rotates without driving anything). A moving means of the link 149** will be described later.

Next, operation of a DC motor for driving a head mechanism will be explained.

A normally and reversely rotatable motor 300 is fitted to the bracket 301, is reduced in speed and rotates a gear 305.

Explanation about transmission of rotation to the head position:

A pinion **300*a* forced onto a shaft of the motor 300 is reduced in speed by a two-stage gear 302, a two-stage gear 303 and a two-stage gear 304 and transmits rotation thereof to the gear 305. A seal 307 is bonded to the gear 305 and checked by two optical sensors 306***a* and 306*b*. The seal 307 is formed of an aluminum plate or the like having high optical reflectance, upon which black portions 307*a*, 307*b* and 307*c* having low optical reflectance are printed. The sensors 306*a* and 306*b* detect the aluminum plate and printed portions as light and shade, respectively.

The gear 305 is connected with a cam 308 and a cam 309 through a shaft 310. On the inner surface side of the cam 308, a cam groove 308*a* for rotating one head arm 312 of a pair of the head arms 312 is provided. On the outer surface side of the cam 308, a cam groove 308*b* for rotating a change arm 142 is provided on the inner surface side of the cam 309, a cam groove (not shown) for rotating the other head arm 312 is provided. On the outer surface side of the cam 309, a cam groove 309*a* for rotating a cam lever 328 and a gear portion 309*b* for transmitting rotation to a two-stage gear 329 are provided (see FIG. 2). The cam groove 308*a* and the cam groove, not shown, for rotating a pair of the head arms 312 are a pair of the cam grooves, each of which operates in the same way, so that only the cam groove 308*a* will be explained in the following explanation.

Explanation of the head position:

Five stop positions are set in the gear 305, and movement thereof to respective set positions and a setting method of the positions will be explained with reference to FIG. 17A. First, in order to detect a reference position, the gear 305 is rotated in the clockwise direction in the figure and rotation thereof is stopped at a position where both the sensor 306*a* and the sensor 306*b* detect the shade (the black portions 307*a* and 307*b*). This position is referred to as a head position H0*a* (hereinafter referred to as H0*a*) and defined as the reference position of the head position.

Explanation about movement of a printing-head position:

Movement of the head position upon the printing will be explained. The gear 305 is rotated from H0*a* in the clockwise direction in the figure and stopped at a position where the sensor 306*a* detects the light. This position is referred to as H1*a*. Next, the gear 305 is rotated in the clockwise direction in the figure and stopped at a position where the sensor 306*a* detects the shade (the black portion 307*b*). This position is referred to as H2*a*. Next, the gear 305 is rotated in the clockwise direction in the figure and stopped at a position where the sensor 306*a* detects the light. This position is referred to as H3*a*. Next, the gear 305 is rotated in the clockwise direction in the figure and stopped at a position where the sensor 306*a* detects the shade (the black portion 307*c*). This position is referred to as H4.

Next, the gear 305 is rotated from H4 in the counterclockwise direction in the figure and stopped at a position where the sensor 306*a* detects the light once and then detects the shade (the black portion 307*b*). This position is referred to as H3*b*. Next, the gear 305 is rotated in the counterclockwise direction in the figure and stopped at a position where the sensor 306*a* detects the light. This position is referred to as H2*b*. Next, the gear 305 is rotated in the counterclockwise direction in the figure and stopped at a position where the sensor 306*a* detects the shade (the black portion 307*a*). This position is referred to as H1*b*. Next, the gear 305 is rotated in the counterclockwise direction in the figure and stopped at a position where both the sensor 306*a* and the sensor 306*b* detect the shade. This position is referred to as H0*b*.

Here, as shown in FIGS. 18A–18D, a positional relation of the gear 305 and the sensor 306*a* and the sensor 306*b* under a state of H2*a* and H2*b* positions, a positional relation of the cam groove 308*a* and a pin 320*a* of a follower 320 connected to the head arm 312, a positional relation of the cam groove 308*b* and a pin 142*a* of the change arm 142, and a positional relation of the cam groove 309*b* and a pin 328*a* of the cam lever 328 are shown in FIG. 18A, FIG. 18B, FIG. 18C and FIG. 18D, respectively.

The motor 300 is stopped immediately after the H2*a* or H2*b* position is detected, so that difference in position of the gear 305 between the stop positions H2*a* and H2*b* is only a little. If the H2*a* and H2*b* positions are compared, the respective pins are located in a profile of the same radius of the cams, so that if a rotation center of each of the cams is defined as reference, then relative positions of the respective pins at H2*a* and H2*b* are the same. Therefore, since the follower 320, the cam lever 328 and the change arm 142 are located at the same position at the H2*a* and H2*b* positions, the H2*a* and H2*b* positions can be regarded as the same in view of the control of the printer. Hence, the H2*a* and H2*b* positions will be referred to as H2 in the following explanation.

Similarly, since the respective pins are set to be stopped at the stop positions in the profile of the same radius of the cams upon the H0*a* and H0*b*, the H1*a* and H1*b* and the H3*a* and H3*b* positions, the H0*a* and H0*b*, the H1*a* and H1*b* and the H3*a* and H3*b* positions will be referred to as H0, H1 and H3 in the following explanation, respectively. H4 is detected only when the gear 305 is rotated in the clockwise direction in the figure.

Figures 17A, 17B, 17C, 17D:
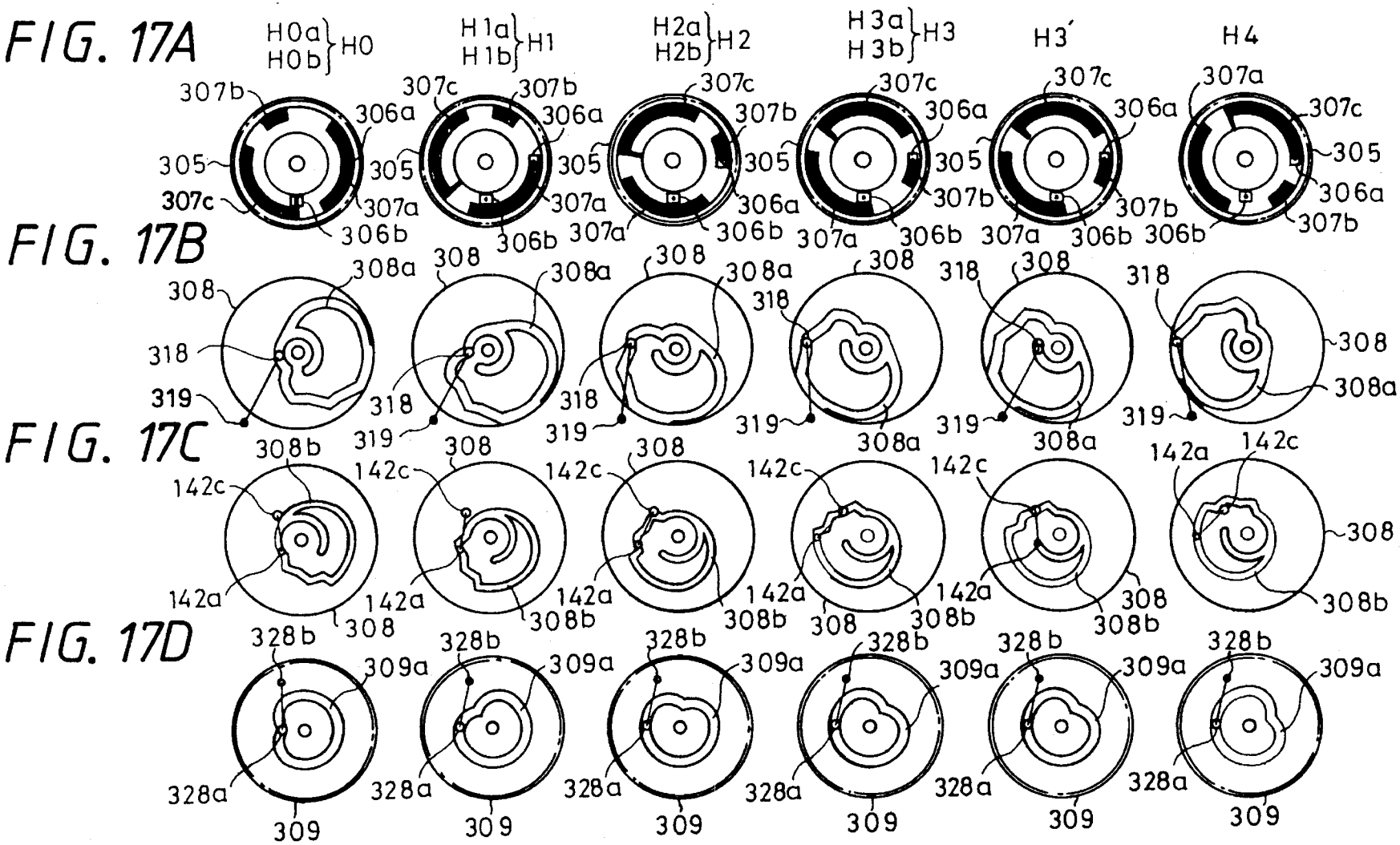
Figure 18A:
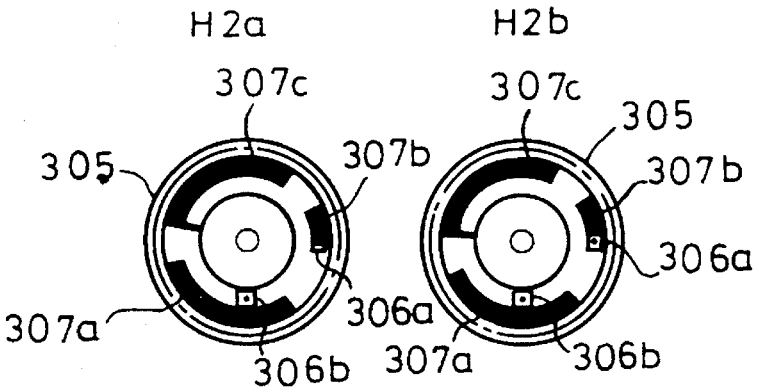
Figure 18B:
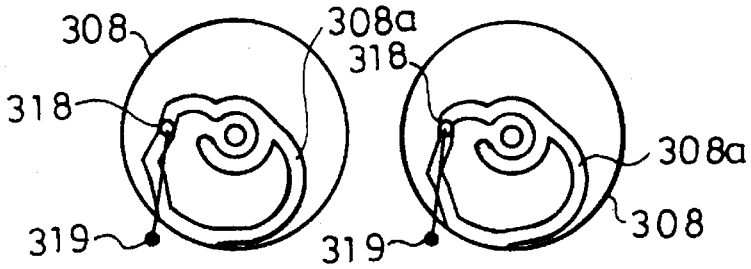
Figure 18C:
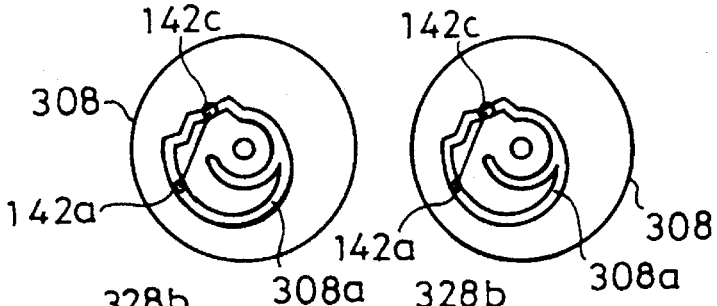
Figure 18D:
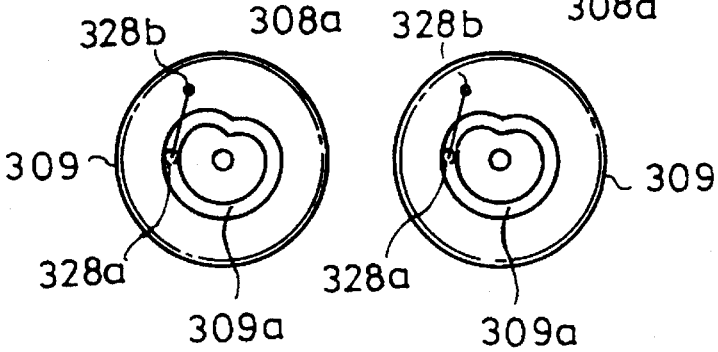

Also, FIG. 17B shows a positional relation of the cam groove 308*a* and the pin 320*a* of the follower 320 connected to the head arm corresponding to the respective positions H0 to H4 of the gear 305. FIG. 17C shows a positional relation of the cam groove 308*b* and the pin 142*a* of the change arm 142 corresponding to the respective positions H0 to H4 of the gear 305. And FIG. 17D shows a positional relation of the cam groove 309*b* and the pin 328*a* of the cam lever 328 corresponding to the respective positions H0 to H4 of the gear 305.

Movement of the head position upon the reading of the ribbon code:

After the reference position H0 is detected, the gear 305 is rotated in the counterclockwise direction in the figure and stopped at a position where after shade detection of the black portion 307*a* at the H0 position, the sensor 306*a* detects the light once, detects the black portion 307*b* and further detects the black portion 307*c*. This position is referred to as H3'. The H3' position is the same as the H3 position in view of the stop position of the gear 305, but operations of the cam plane 308*a* and the cam plane 308*b* at H3' are different from those at H3, so that these positions are distinguished. After detection of the H3' position, the gear 308 is rotated in the clockwise direction in the figure and then returned to the reference position H0.

Explanation about operations of the cams 308 and 309:

Shapes of the respective cam grooves 308*a*, 308*b* and 309*a* will be explained with reference to FIGS. 19 to 21.

As shown in FIG. 19, the cam groove 308*a* is composed of passages 308*a*0, 308*a*1, 308*a*2 and 308*a*3 located in a concentric-circle fashion relative to the rotation center of the cam 308, curve passages connecting smoothly the passages 308*a*0 and 308*a*1, the passages 308*a*1 and 308*a*2 and the passages 308*a*2 and 308*a*3 and a curve connecting smoothly the passage 308*a*3 and the middle of the passage 308*a*0. A pin 318*a* of the link 315 is stopped in the passage 308*a*0 upon the positions H0, H1 and H3' and stopped in the passages 308*a*1, 308*a*2 and 308*a*3 upon the H2, H3 and H4 positions, respectively.

As shown in FIG. 20, the cam groove 308*b* is composed of passages 308*b*0, 308*b*1, 308*b*2 and 308*b*3 located in a concentric-circle fashion relative to the rotation center of the cam 308, curve passages connecting smoothly the passages 308*b*1 and 308*b*1, the passages 308*b*1 and 308*b*2 and the passages 308*b*2 and 308*b*3 and a curve connecting smoothly the passage 308*b*3 and the middle of the passage 308*b*0. The pin 142*a* of the change arm 142 is stopped in the passage 308*b*0 upon the positions H0 and H3', and is stopped in the passages 309*b*1 and 308*b*2 upon the H1 and H2 positions, respectively, and is stopped in the passage 308*b*3 upon the H3 and H4 positions.

As shown in FIG. 21, the cam groove 309*b* is composed of a passage 309*b*0, a passage 309*b*1 located in a concentric-circle fashion relative to the rotation center of the cam 309 and curves smoothly connecting both of ends of the passages 309*b*1 and 309*b*1. The pin 328*a* of the cam lever 328 is stopped in the passage 309*b*0 upon the position H0 and in the passage 309*b*1 upon the positions H1, H2, H3, H3' and H4, respectively.

Operation of the respective head positions and the cams:

Initial operation

With the gear 305 being first rotated in order to detect the reference position 0, the cam 308 and the cam 309 are similarly rotated in the clockwise direction in the figure. Although a branch point 308*a*4 to the passage 308*a*3 and a branch point 308*b*4 to the passage 308*b*3 are provided in the passage 308*a*0 of the cam groove 308*a* and the passage 308*b*0 of the cam groove 308*b*, respectively, if the cams are rotated in the clockwise direction in the figure, then a pin 312*a* and the pin 142*a* are prevented from disturbing the rotations of the respective cams.

Explanation about construction of the head arm 312:

As shown in FIG. 22, a pair of the head arms 312 are rotatably supported by a shaft 319, and a pair of the levers 320 and a pair of arms 321 are rotatably supported by the same shaft 319, to which a pair of fixed plates 311 (see FIG. 3) fixed at a part thereof on the covering plate 404 is fitted. The shaft 319 is supported by the chassis 401. Also, a pair of followers 319*a* are fixed on the shaft 319.

The pins 320*a* of a pair of the levers 320 are coupled to links 313. To the links 313, links 314 and links 315 are coupled through pins 316. The other pins 317 of the links 314 pierce through the long apertures 312*a* of the arms 312. The other pins 318 of the links 315 are engaged with the cam groove 308*a* of the cam 308 through an aperture 319*b* of the followers 319*a* fixed on the shaft 319. The head arms 312 are disposed between the links 314 and the arms 321 which are connected by the pins 316. The pins 317 are connected to the arms 321 through the long apertures 312*a* of the head arms 312. The head arms 312 and the arms 321 are biased by springs 327 so as to draw each other, while relative movement amounts thereof are restricted by the pins 317 and the long apertures 312*a* with employing the shaft 319 as the rotation center thereof.

Also, the arm 321 is biased by a spring 326, and by this force the follower 319*a* is biased in the center direction of the cam 308. A heat sink 322 is fitted to a pair of the head arms 312. To the heat sink 322, a head 323 and a ribbon guide 324 serving also as a reflection mirror are fitted.

The head 323 is provided with a large number of heating bodies and wiring members (not shown) for supplying electricity to the heating bodies and a head cover 325.

Explanation about movement of the head 323:

Movement of the head arm will be explained with reference to FIGS. 23A–23D. The head 323 is given four stop positions.

Figure 23A:
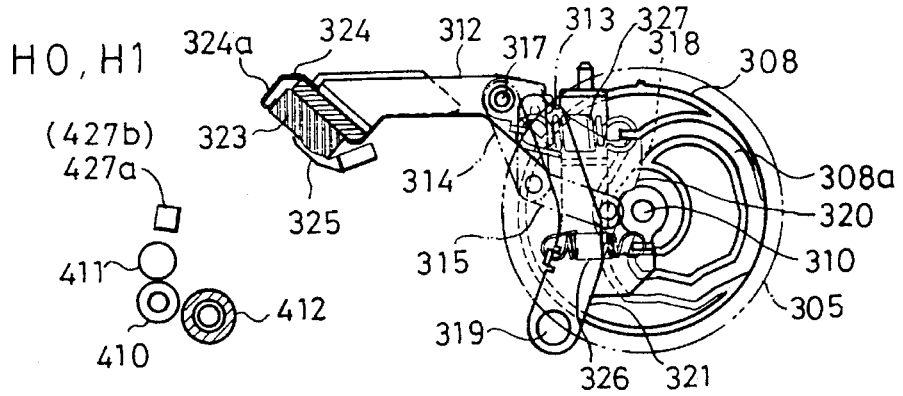

As shown in FIG. 23A, when the gear 305 is stopped at the H0 and H1 positions, the head 323 is located at a standby position.

Figure 23B:
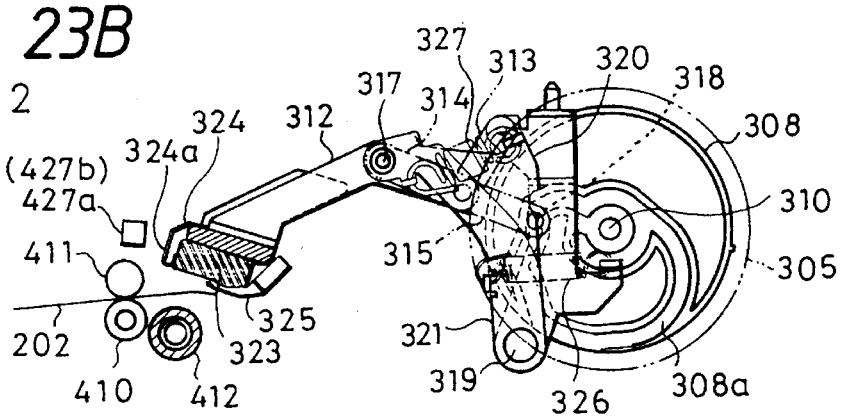

As shown in FIG. 23B, when the gear 305 is moved to the H2 position, the head 323 is moved so that a plane portion 324*a* of the ribbon guide 324 should be moved in front of optical reflection type ribbon-mark sensors 427*a* and 427*b* fitted to the guide 426.

Here, a detecting method of the header mark 11 and the patch mark 12 of the ribbon will be explained.

The ribbon guide 324 is made of a material which is made by subjecting a stainless plate to a mirror-like finishing and has high optical reflectance. The header mark 11 and the patch mark 12 of the ink ribbon 10 are belt-shaped marks having low optical transmittance and reflectance. Since portions except the header mark 11 and the patch mark 12 of the ink ribbon 10 have high optical transmittance, when there is the ink ribbon 10 between the sensors and the plane portion 324*a*, the sensor 427*a* and the sensor 427*b* detect the ribbon-guide plane portion 324*a* as light. When there are the above marks between the sensors and the plane portion 324*a*, the sensors detect the plane portion as shade.

Since the header mark 11 is set to be a belt-shaped one over the entire ribbon width, both of the sensors 427*a* and 427*b* detect the black portion. Since the patch mark 12 is set to be a belt-shaped one over about half of the ribbon width including a detection range of the sensor 427*a*, the sensor 427*a* and the sensor 427*b* detect the shade and the light, respectively.

Figure 23C:
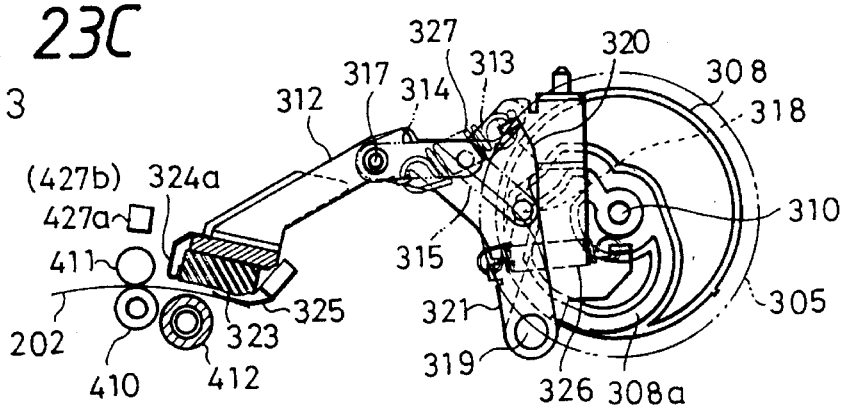

Next, as shown in FIG. 23C, when the gear 305 is moved to the H3 position, the head 323 is moved to a position where there is a little space between the head and a platen 412. The head 323 is moved to the H3 position, whereby the printer according to the present invention changes a carrying passage of the paper. The detail thereof will be described later.

Figure 23D:
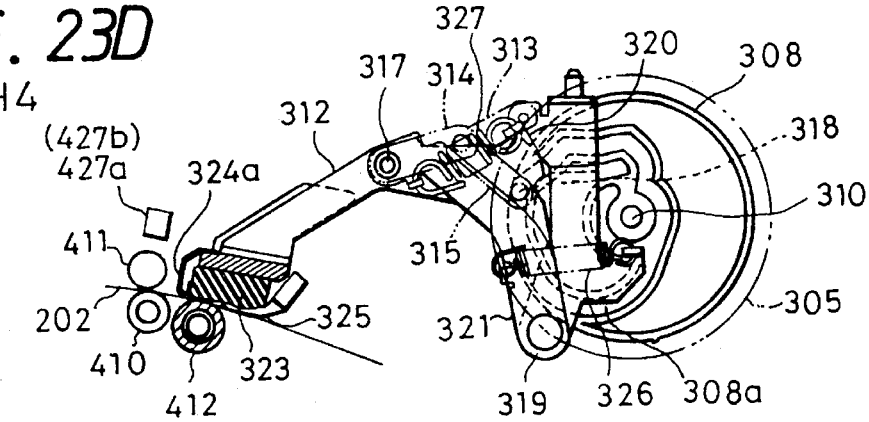

As shown in FIG. 23D, when the gear 305 is moved to the H4 position the head 323 is pressed on the platen 412. The respective links are driven by the cam 308. The arm 321 rotates the head arm 312 in the direction to the platen 412. At last, the head 323 is brought in contact with the platen 412. Further, the arm 321 is rotated by the cam 308 thereafter, but since the head 323 is already in contact with the platen 412, the head arm 312 cannot be rotated. Therefore, the arm 321 and the head arm 312 are relatively rotated, and the restriction of the above pin 316 and a long aperture 321*a* of the head arm 312 is released. Then, the head arm 312 presses the head 323 on the platen 412 through the spring 327.

Explanation about construction of the change arm 142:

The change arm 142 is rotated by the cam groove 308*b* and given four stop positions shown in FIGS. 24A–24D. The change arm 142 is rotatably supported by a supporting shaft 142C and drives a locking click 143 and a brake click 144, which are rotatably supported by the bracket 100. The locking click 143 and the brake click 144 are respectively engaged with the gear portion 146 of the S reel base 146 and the gear 145 to prevent the respective gears from rotating. Also, the change arm 142 drives the link 149 connected thereto by a shaft 149*c*. The link 149 is guided at an aperture portion 149*b* thereof by the rotation shaft 146*c* of the S reel base 146, and movement of the link 149 permits the link head portion 149*a* to prevent or release the engaging of the pendulum gear 124 with the gear 145 of the S reel base 146.

Figure 24A:
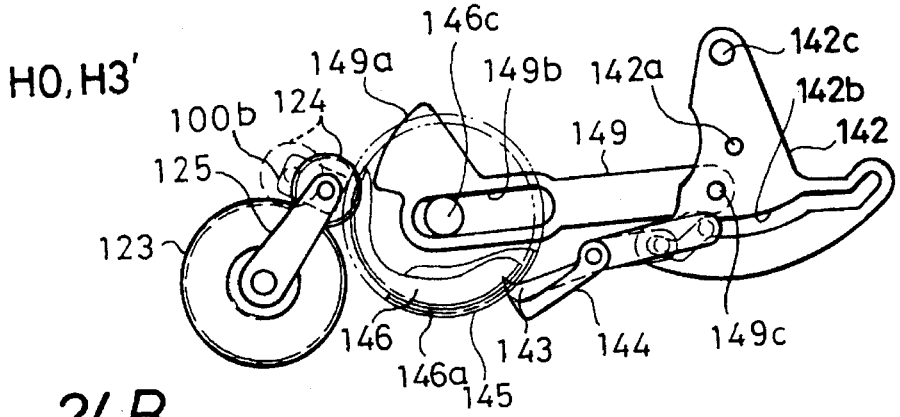

FIG. 24A shows a state in which the gear 305 is located at the H0 and H3' positions. In this state the locking click 143 is engaged with the gear portion 146*a*, the brake click 144 is released, and the link 149 does not restrict movement of the pendulum gear 124.

Figure 24B:
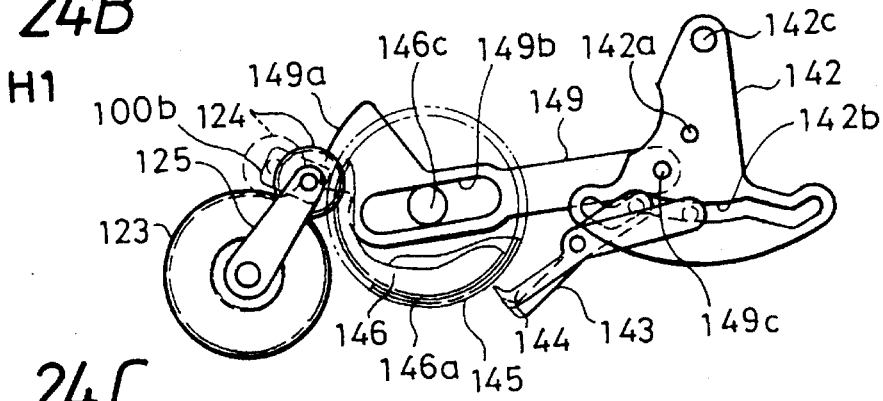

FIG. 24B shows a state in which the gear 305 is located at the H1 position. In this state both of the locking click 143 and the brake click 144 are released, and the link 149 does not restrict movement of the pendulum gear 124.

Figure 24C:
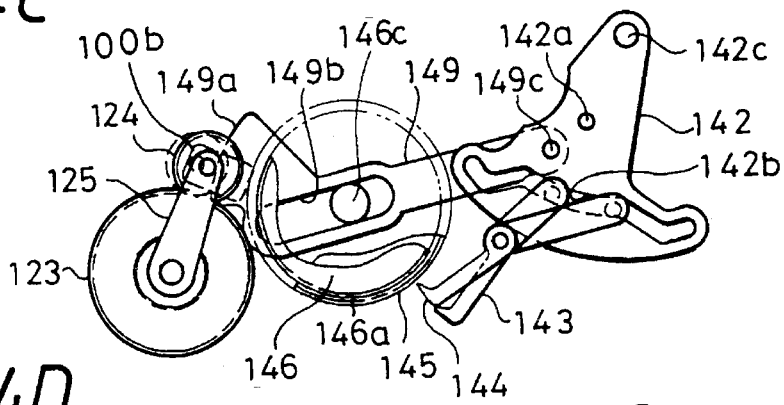

FIG. 24C shows a state in which the gear 305 is located at the H2 position. In this state both of the locking click 143 and the brake click 144 are released, and the link 149 restricts movement of the pendulum gear 124.

Figure 24D:
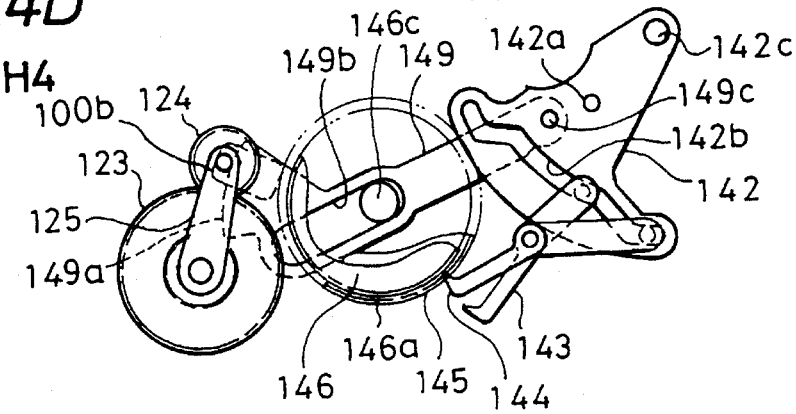

FIG. 24D shows a state in which the gear 305 is located at the H3 and H4 positions. In this state the locking click 143 is released, the brake click 144 is engaged with the gear 145, and the link 149 restricts movement of the pendulum gear 124.

Explanation about construction of the cam lever 328:

The cam lever 328 is rotated by the cam groove 309*a* with a supporting shaft 328*b* as a center. The cam lever 328 is given two stop positions, as shown in FIGS. 25A and 25B, respectively. A head portion 326*a* of the cam lever 328 restricts movement of a pendulum arm 331 and can also slide the locking lever 332 slidably supported by the holder 422 (see FIG. 9) with movement of a pin 328*c* of the cam lever 328.

As to a pendulum gear 330 and the pendulum arm 331, when the cam 308 is rotated by a friction force generated by a spring (not shown) or the like in the clockwise direction in the figure, rotation is transmitted from the gear portion 309*b* of the cam 309 to the two-stage gear 329 rotatably fitted to a shaft end of the shaft 319. Then, the pendulum arm 331 is rotated, and the pendulum gear 330 is engaged with the gear 22 of the code ring 21 to rotate the code ring 21.

FIG. 25A shows a state in which the gear 305 is located at the H0 position. In this state the cam lever 328 restricts the pendulum arm 331 to prevent the pendulum gear 330 from being engaged with the gear 22, and the locking lever 332 is moved backward to allow the ribbon door 420 to be opened.

FIG. 25B shows a state in which the gear 305 is located at the H1, H2, H3, H3' and H4 positions. In this state the cam lever 328 does not restrict the pendulum arm 331 from moving the pendulum gear 330 into engagement with the gear 22, and the locking click 421 is locked by the locking lever 332 to make it impossible to open the ribbon door 420.

Lastly, a rotating method of the ribbon code ring 21 will be explained. After the gear 305 is positioned at the H0 position, the gear 305 is rotated in the clockwise direction in the figure and moved to the H3' position. Next, the gear 305 is rotated in the counterclockwise direction in the figure and returned to the H0 position again. At this time, during the movement thereof from the H3' position to the H0 position, the pendulum gear 330 is engaged with the gear 22 to rotate the ribbon-code ring 21, and the information mark 23 is read by a sensor 335.

During this operation, the pin 318 of the head arm 312 is moved within the passage 308*a*0 of the cam groove 308*a*, so that the head arm 312 is not moved. Similarly, the pin 142*a* of the change arm 142 is moved within the passage 308*b* of the cam groove 308*b*, so that the change arm 142 is not moved. Therefore, in view of the printer, only the portion driven by the cam 309*a* is moved, while the other portions remain stationary. Also, during the reading of the information mark, the ribbon door 420 cannot be opened. Whereby the misreading of the information mark caused by the touch of a user is prevented.

Next, a series of operations of printing operations will be explained with reference to FIGS. 26 to 31.

Initialization

The following initializations are performed after a power-source switch is turned on.

Initialization of the paper position:

It is confirmed that the paper position is located at the P0, as shown in FIG. 26. If the paper position is not located at P0, then the motor 101 is rotated to move the paper position to P0.

Initialization of the head position:

It is confirmed that the head position is located at H0, as shown in FIG. 26. If the head position is not located at H0, as then the motor 300 is rotated to move the head position to H0. If the P0 and the H0 positions cannot be confirmed, then the printer is judged as having trouble.

Confirmation of the ink ribbon 10 and the reading of the ribbon code:

It is confirmed with a switch (not shown) that the ribbon door 420 is closed, and it is confirmed with a switch 428 that the ribbon cassette 1 is loaded. If they are confirmed, then the motor 300 is rotated to thereby rotate the ribbon code ring 21 whereupon the information mark 23 is read by the sensor 335. If the information mark 23 is not matched with various information marks previously stored in the set, then it is judged that the ribbon cassette 1 is not loaded, and then an alarm is given.

Also, if the switch (not shown) of the ribbon door 420 and the switch 428 of the ribbon cassette I are turned ON/OFF while the set is kept on standby, then it is judged that the ribbon cassette 1 is exchanged, and the ribbon code is read again.

Printing operation

Printing operation is started by pushing a switch or the like.

Confirmation of the paper feeding tray 200 and the printing paper:

It is confirmed by a switch 429 (see FIG. 3) that the paper feeding tray 200 is loaded, and it is confirmed by sensors 430*a* and 430*b* that there is the printing paper 202 in the paper feeding tray 200. If they cannot be confirmed, then it is judged that there is no printing paper therein, and an alarm is given.

Head searching of the ink ribbon 10 and movement of the head position:

The head position is moved from the H0 position shown in FIG. 26 to the H2 position shown in FIG. 27, and until the sensor 427*a* and the sensor 427*b* detect the header mark 11 of the ink ribbon 10, the motor 101 is rotated, and the ink ribbon 10 is wound by rotation of the T reel base 111 to search for the header mark 11 of the ink ribbon. Since a rotation time of the motor 101 is set in advance, if the header mark 11 can not be detected even when the motor 101 is rotated for the set time, then it is judged that there is not enough remaining ribbon, and an alarm is generated.

Movement of the paper position:

The motor 101 is rotated to move the paper position from P0 to P1. That is, the rotation of the motor 101 permits the paper feeding arm 204 to be moved upward by the paper feeding cam 416 through the gear 118, and then the printing paper 202 is brought upward and then pressed on the paper feeding roller 213. Then, the printing paper 202 is drawn inside by the paper feeding roller 213 and sandwiched between the paper feeding roller 212 and the separating roller 214 to feed the paper.

The carrying of the printing paper and detection thereof by a paper feeding sensor 224:

The stepping motor 102 is rotated to carry the printing paper 202 until the paper feeding sensor 224 detects the paper. If the printing paper is not detected by the paper feeding sensor 224 after the stepping motor 102 is rotated by a certain amount, then it is judged as a paper feeding error, and an alarm is given.

Movement of the paper position:

A position where a head of the printing paper 202 is detected by the paper feeding sensor 224 is defined as a reference, and the printing paper is carried by a predetermined amount therefrom. The printing paper is held between the capstan 410 and the pinch roller 411, and thus, is caused to advance when the motor 102 is rotated. The paper is moved from the paper position P1, as shown in FIG. 28, to the position P2, as shown in FIG. 29, when the motor 101 is rotated.

The pushing down of the printing paper and movement of the head position:

Subsequently, when a position where the head of the printing paper is detected by the paper feeding sensor 224 is defined as a reference and the printing paper is carried by a predetermined amount therefrom, the head of the printing paper is located below the head cover 325. While the head of the printing paper lies below the head cover 325, the motor 300 is rotated to move the head position from the position shown in FIG. 23B to that shown in FIG. 23C, whereby the head position is moved from the H2 position shown in FIG. 28 to the H3 position shown in FIG. 29. The head of the printing paper moving substantially in the center direction of the S reel base 146 is pushed by the head cover 325 to thereby change its moving direction to a direction of a passage M formed of the chassis 401 and a guide 406. When the printing paper is carried further, the head of the printing paper 202 is led into the passage M.

Detection thereof by a sensor 415:

When the printing paper 202 is further carried, the head of the printing paper is detected by the sensor 415. If the printing paper is not detected by the sensor 415 even when carried from a position of the paper feeding sensor 224 by a predetermined amount, then it is judged that a paper feeding error is caused, and then an alarm is given.

Detection of a rear end of the printing paper by the paper feeding sensor 224:

When the printing paper 202 is further carried, the rear end of the printing paper is detected by the paper feeding sensor 224. Length (in the carrying direction) of the printing paper is detected on the basis of a number of steps taken by the stepping motor 102 from the detection of the head of the printing paper by the paper feeding sensor 224 to the detection of the rear end of the printing paper thereby. The detected length of the printing paper 202 is compared to a length of predetermined kinds of printing papers, whereby the kind and size of the printing paper is judged. If the paper is a paper having a size other than one of the predetermined sizes, or the discriminated kind of the printing paper does not correlate with the kind of the ink ribbon previously discriminated from the information mark 23 of the ribbon cassette 1, then an alarm is given.

3-mm skip of the printing paper:

After the above detection of the rear end of the printing paper by the paper feeding sensor 224, the printing paper is successively carried a distance of 3 mm in the paper feeding direction to perform the detection thereof by the paper feeding sensor 224. If the printing paper is detected again by the paper feeding sensor 224 while the paper is carried the 3 mm distance, then it is judged that the former detection is based on a print of a rear surface of the printing paper, stains or the like, and then the second detected position is set to the true rear end of the printing paper.

Movement of the printing paper to the printing position:

The printing paper is carried by a predetermined amount (several mm) from the position where the rear end of the printing paper is detected, whereby the printing paper is moved to the printing position and then stopped.

Movement of the head position:

The motor 300 is rotated to change the operation from the one shown in FIG. 23C to the one shown in FIG. 23D, whereby the head 323 is pressed on the platen 412, and the head position is moved from the H3 position shown in FIG. 29 to the H4 position shown in FIG. 30.

Printing processing

The motor 101 is rotated to take up the ink ribbon 10 by the rotation of the T reel base 111, and at the same time, the stepping motor 102 is reversely rotated to carry the printing paper 202 in the opposite direction to the above carrying direction by reversal rotation of the capstan 410. Then, the printing is performed by the head 323.

Movement of the head position and removal of slack of the ink ribbon:

The motor 300 is rotated to move the head position from the H4 position shown in FIG. 30 to the H2 position shown in FIG. 31, and the motor 102 is reversely rotated for a predetermined time to thereby engage the pendulum gear 124 with the S reel base 146. Then, the S reel base 146 is rotated in the take-up direction to remove the slack of the ink ribbon 10.

The head searching of the ink ribbon 10 and movement of the head position:

The motor 101 is rotated until the sensor 427*a* and the sensor 427*b* detect the patch mark 12 of the ink ribbon 10 in the next printing operation. The T reel base 111 is rotated in the, take-up direction of the ribbon to take-up the ink ribbon 10 and search the head of the ribbon. Since the rotation time of the motor 101 is previously determined, if the patch mark 12 cannot be detected after the motor 101 is rotated for the set time, it is judged that there is not enough remaining ink ribbon, the ribbon is cut or the like. Then, an alarm is given.

The pushing down of the printing paper and movement of the head position:

In the same way as the pushing down of the paper upon the paper feeding, the position where the head of the printing paper is detected by the paper feeding sensor 224 is defined as a reference. The printing paper is carried by a predetermined amount therefrom. The head of the printing paper is located below the head cover 25. While the head of the printing paper 202 is located below the head cover 325, the head position is moved from the H2 position shown in FIG. 28 to the H3 position shown in FIG. 29 by changing the head position from the one shown in FIG. 23B to the one shown in FIG. 23C. Then, the head 323 pushes the printing paper 202 down.

In the above printing operation on the printing paper 202, the above printing processing is repeated a total of four times in case of color printing in order to subject the paper to the printing with respective colors and lastly subject a surface thereof to coating processing.

Movement of the head position and removal of the slack of the ink ribbon:

The motor 300 is rotated, and the head position is moved from the one shown in FIG. 23D to the one shown in FIG. 23B to thereby move the same from the H4 position shown in FIG. 30 to the H2 position shown in FIG. 31. Also, the motor 102 is reversely rotated for a predetermined time to thereby engage the pendulum gear 124 with the S reel base 146. Then, the S reel base 146 is rotated in the take-up direction to remove the slack of the ink ribbon 10.

Delivery of the printed paper

The capstan 410 is rotated by reverse rotation of the stepping motor 102, and the paper delivering roller 225 is rotated by reverse rotation of the motor 102, to thereby deliver the printing paper 202 through the paper delivering opening 703. If a paper delivering sensor 227 detects the printing paper after a predetermined amount of the paper is carried, then it is judged as a paper delivery error. Then, an alarm is given.

As explained above, the printer according to the present invention is formed of the motor 101 which rotates the T reel base 111 and takes up the ink ribbon 10 to search the optional head of the ink ribbon, the stepping motor 102 for feeding and delivering the printing paper and removing the slack of the ink ribbon by the rotation of the S reel base 146, and the motor 300 for performing the discriminating operation of the ribbon code ring 21 and the printing operation by the head 323. The three motors 101, 102 and 300 allow the printer to operate without interlocking the movement of the head 323 with the capstan 410, the paper feeding arm 204 and the separating roller 214. The passage of the printing paper 202 is checked by the three sensors, that is, the paper feeding sensor 224, the sensor 415, and the paper delivering sensor 227. Therefore, even in the case of a jam of the printing paper 202, interruption during the printing operation or the like, the printing paper can be carried, and the ink ribbon can be taken up while the head is being moved at the most proper timing, so that when the power source is supplied again, operation can be automatically restored.

Also, a conventional link mechanism for driving the capstan and the paper feeding mechanism is abolished, whereby miniaturization of the printer can be realized. The head 323 can be freely moved, whereby the printing paper can be pushed down and the passage of the paper can also be provided at the printing unit. Therefore, the printer can be further miniaturized.

Also, the cam 308 for operating the head 323 is provided as described above, whereby even when the code ring 21 of the ribbon code is rotated, the head 323 and other members are prevented from being moved unnecessarily.

Also, the slack portion of the ink ribbon 10 can be rewound around the S reel base 146 in cooperation with the cam 308 of the head 323 and the stepping motor 102. Therefore, when the printing paper 202 and the ink ribbon 10 are not matched with each other, the printing paper is automatically delivered, and the ink ribbon 10 is rewound, whereby wasteful use of the ink ribbon can be prevented.

The present invention is not limited to the above-mentioned embodiment shown in the drawings, but rather, is also intended to cover all modifications which can be effected without deviating from the gist of the invention.

What we claim is:

1. A video printer comprising:

a platen, printing head, ribbon cassette, ink ribbon, cam mechanism and a ribbon code ring;

a normally and reversely rotatable first drive motor, said first drive searching the ink ribbon of the ribbon cassette housed in said printer and taking up the ink ribbon by a take-up reel during a printing operation;

a normally and reversely rotatable second drive motor, the second drive feeding a printing paper housed in a tray through a carrying roller by a capstan and a pinch roller to a printing position and a paper delivering position;

a normally and reversely rotatable third drive motor for identifying said ink ribbon by said ribbon code ring and for moving said printing head, which subjects said printing paper to a printing processing, by pressing the ink ribbon thereon with said platen; and said printing head moved by rotation of the cam mechanism drivingly connected to said third drive motor.

2. A printer as claimed in claim 1, wherein said first drive motor comprises a DC motor.

3. A printer as claimed in claim 2, wherein said second drive motor comprises a stepping motor.

4. A printer as claimed in claim 3, wherein said third drive motor comprises a DC motor.

5. A video signal printing apparatus comprising:

a cassette comprising a supply reel, a take-up reel, and a ribbon wrapped around said reels;

a main chassis for receiving said cassette;

a capstan and a pinch roller for feeding a paper to a paper printing position;

a motor means for rotating said capstan and said pinch roller;

a platen for receiving the paper in said paper printing position, said platen being disposed in a position downstream of said capstan and pinch roller in a feeding direction;

a head means for heating and pressing said ribbon onto the paper in said printing position, said head means being movable between a head printing position in which said ribbon is pressed onto said paper and a head waiting position in which said head releases said ribbon from said paper;

a control means for selectively moving said head means between said head printing position and said head waiting position, and for causing a slack of the ribbon to wind up onto said supply reel upon said head means moving to said head waiting position;

a pendulum gear means drivingly connected to said motor means for selectively driving said supply reel for winding said slack of ribbon.

6. The video signal printing apparatus according to claim 5, wherein said pendulum gear means drives said supply reel upon rotation of said motor means in a first direction, and disengages from said supply reel upon rotation of said motor means in a second direction.

7. A video signal printing apparatus comprising:

a cassette comprising a supply reel, a take-up reel, and a ribbon wrapped around said reels;

a main chassis for receiving said cassette;

a capstan and a pinch roller for feeding a paper to a paper printing position;

a motor means for rotating said capstan and said pinch roller;

a platen for receiving the paper in the paper printing position, said platen being disposed in a position downstream of said capstan and pinch roller in a feeding direction;

a head means for heating and pressing said ribbon onto the paper in the printing position, said head means being movable between a head printing position in which said ribbon is pressed onto said paper and a head waiting position in which said head releases said ribbon from said paper;

a control means for selectively moving said head means between said head printing position and said head waiting position, and for causing a slack of the ribbon to wind up onto said supply reel upon said head means moving to said head waiting position; and a pendulum gear means drivingly connected to said motor means for selectively driving said supply reel for winding said slack of ribbon, said pendulum gear means drives said supply reel upon rotation of said motor means in a first direction, and disengages from said supply reel upon rotation of said motor means in a second direction;

wherein said control means prevents said pendulum gear means from moving into driving engagement with said supply reel when said head means is in said head printing position.

8. The video signal printing apparatus according to claim 7, wherein a torque limiting means is provided between said pendulum gear means and said supply reel for limiting driving torque of said supply reel when winding said slack of ribbon.

9. A video signal printing apparatus comprising:

a ribbon cassette;

a main chassis for receiving said ribbon cassette;

a tray means for holding a supply of printing papers;

a first feeding roller for feeding one of the papers into said main chassis;

an arm means for pressing one of the papers held in said tray means into engagement with said first feeding roller;

a capstan and a pinch roller for feeding said one of papers to a printing position after being fed into said chassis by said first feeding roller, said capstan and pinch roller being movable into and out of engagement with each other;

a motor means for rotating one of said capstan and said pinch roller;

a passage means for guiding said one of the papers to a predetermined position;

a platen for receiving one of the papers disposed in the predetermined position;

a head means for heating a ribbon from the ribbon cassette received in the main chassis, said head means being disposed on a moveable arm;

a moving means for moving said head means between a plurality of positions; and a control means having a plurality of cams disposed on a common axis, for controlling rotatable movement of said arm means for pressing said papers into engagement with said first feeding roller, and for controlling movement of said capstan and said pinch roller into and out of engagement with each other.

10. The video signal printing apparatus according to claim 9, wherein said control means selectively controls said arm means and said capstan and pinch roller to stop at a plurality of positions.

11. The video signal printing apparatus according to claim 9, further comprising a locking means for selectively preventing said tray means from being removed from said main chassis, wherein one of said cams controls said locking means.

12. The video signal printing apparatus according to claim 9, further comprising a separating roller and a second feeding roller disposed between said first feeding roller and said capstan and pinch roller for feeding said paper forwardly, wherein one of said cams controls movement of said separating roller into and out of engagement with said second feeding roller.

13. The video signal printing apparatus according to claim 12, further comprising a shutter means for controlling said paper feeding, wherein one of said cams controls an opening of said shutter means.

14. The video signal printing apparatus according to claim 13, further comprising a releasing lever for controlling movement of said separating roller and said shutter means, wherein one of said cams engages said releasing lever to control movement of said separating roller and said shutter means.

15. The video signal printing apparatus according to claim 14, further comprising a spring means for biasing said releasing lever into engagement with the cam engaging said releasing lever.

16. The video signal printing apparatus according to claim 9, further comprising a pinch roller arm rotatably supporting said pinch roller, and a spring means for biasing said pinch roller arm into engagement with one of said cams.

17. The video signal printing apparatus according to claim 9, wherein said control means further comprises a gear operably connected to said cams for rotation therewith, and a sensor means for detecting a rotation position of said gear for selectively stopping said cams at predetermined rotational positions.

18. The video signal printing apparatus according to claim 17, wherein said gear has a reflection surface thereon, said reflection surface having predetermined portions of high optical reflectance and predetermined portions of low optical reflectance, wherein said sensor means detects the optical reflectance of said gear to determine its rotational position.

19. The video signal printing apparatus according to claim 18, wherein said predetermined portions of low optical reflectance comprise two portions of low optical reflectance disposed approximately 120 degrees from each other, and said sensor means comprises two sensors disposed approximately 120 degrees from each other with respect to the rotational axis of said gear.

20. A printer comprising:

a main chassis for receiving a ribbon cassette;

a first feeding roller for feeding a paper into said main chassis;

a pressing arm means for pressing the paper into engagement with said first feeding roller;

a capstan and a pinch roller for feeding the paper to a printing position after being fed into said chassis by said first feeding roller;

first moving means for moving said capstan and pinch roller into and out of engagement with each other;

a printing head means for heating a ribbon from the ribbon cassette and pressing the ribbon onto the paper;

second moving means for moving said printing head means between a head printing position and a head waiting position;

a supply reel base for driving a supply reel of the cassette; and a take-up reel base for driving a take-up reel of the cassette;

a first reversible drive motor drives said take-up reel base when rotated in a first direction and controls engagement of said pressing arm means and movement of said first moving means when rotated in a second opposite direction.

21. The printer as set forth in claim 20, further comprising a second reversible drive motor, wherein said second reversible drive motor drives said supply reel when rotated in a first direction and drives said first feeding roller and said capstan when rotated in both said first direction and a second opposite direction.

22. The printer as set forth in claim 21, further comprising a third reversible drive motor, wherein said third reversible drive motor controls movement of said second moving means for moving said printing head means.

23. The printer as set forth in claim 22, further comprising a gear driven by said third reversible drive motor, said gear having a first cam groove for controlling movement of said second moving means.

24. The printer as set forth in claim 23, wherein said gear has a second cam groove for causing selective disengagement of said second motor from said supply reel base.

25. The printer as set forth in claim 20, further comprising a pendulum gear driven by said first reversible drive motor, said pendulum gear engaging a drive train to said take-up reel base when said first drive motor is rotated in its first direction, and engaging a drive train to a control means for moving said pressing arm means and said first moving means when said first drive motor is rotated in its second opposite direction.

26. The printer as set forth in claim 25, wherein said control means comprises a plurality of cams disposed on a common axis, for controlling rotatable movement of said pressing arm means and said first moving means.

27. A method for producing a paper copy of a video image, comprising the steps of:

providing a feeding roller, a first drive motor, a control cam assembly, a second drive motor, a capstan and pinch roller assembly, a printing head, a printing ribbon, and a third drive motor;

pressing a paper into engagement with the feeding roller by rotating the first drive motor in a first direction to position the control cam assembly in a predetermined position;

rotatably driving said feeding roller by rotating the second drive motor in a first direction so as to feed the paper toward the capstan and pinch roller assembly;

rotatably driving said capstan by rotating said second drive motor in its first direction so as to feed the paper to a printing position;

moving the printing head into a first position where the head presses the printing ribbon into engagement with the paper by rotating the third drive motor to a first predetermined position;

printing an image upon the paper; and rotatably driving said capstan by rotating said second drive motor in a second direction opposite to its first direction so as to deliver the paper to a paper delivering position.

28. The method as set forth in claim 27, further comprising the step of moving said printing head into a second position where the head releases the printing ribbon from engagement with the paper by rotating the third drive motor to a second predetermined position after said printing step.

29. The method as set forth in claim 28, further comprising the step of providing a pendulum gear and a gear for driving a supply reel of a ribbon cassette, and removing slack from the printing ribbon after said printing head is moved into said second position, said step of removing slack comprising rotating said second drive motor in its first direction so as to engage the pendulum gear with the gear for driving a supply reel of a ribbon cassette.

30. The method as set forth in claim 27, wherein said printing step includes providing a pendulum gear and a gear for driving a take-up reel of a ribbon cassette and advancing the printing ribbon past the printing head by rotating said first drive motor in a second direction opposite to its first direction so as to engage the pendulum gear with the gear for driving a take-up reel of a ribbon cassette.

31. The method as set forth in claim 27, further comprising providing a paper supply tray and a printer chassis, and locking the paper supply tray with the printer chassis by rotating said first drive motor in its first direction to position the control cam assembly in a predetermined position.

* * * * *